US012196446B2

(12) United States Patent
Kim et al.

(10) Patent No.: US 12,196,446 B2
(45) Date of Patent: Jan. 14, 2025

(54) AIR CONDITIONER

(71) Applicant: SAMSUNG ELECTRONICS CO., LTD., Suwon-si (KR)

(72) Inventors: Munsub Kim, Suwon-si (KR); Jaewoo Choi, Suwon-si (KR); Duhan Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 365 days.

(21) Appl. No.: 17/727,178

(22) Filed: Apr. 22, 2022

(65) Prior Publication Data

US 2023/0010148 A1 Jan. 12, 2023

Related U.S. Application Data

(63) Continuation of application No. PCT/KR2022/004557, filed on Mar. 31, 2022.

(30) Foreign Application Priority Data

Jul. 12, 2021 (KR) ..... 10-2021-0090975

(51) Int. Cl.
*F24F 13/14* (2006.01)

(52) U.S. Cl.
CPC ..... *F24F 13/1413* (2013.01); *F24F 2221/14* (2013.01)

(58) Field of Classification Search
CPC ..... F24F 2221/14; F24F 13/1413; F24F 2013/1446; F24F 1/0047; F24F 13/06; F24F 11/79
See application file for complete search history.

(56) References Cited

U.S. PATENT DOCUMENTS

| | | | | |
|---|---|---|---|---|
| 11,333,376 | B2 | 5/2022 | Lee et al. | |
| 2018/0252429 | A1 | 9/2018 | Kojima et al. | |
| 2020/0263882 | A1* | 8/2020 | Kim | F24F 1/0014 |

FOREIGN PATENT DOCUMENTS

| | | | | |
|---|---|---|---|---|
| CN | 108302748 | | 7/2018 | |
| CN | 209459170 | | 10/2019 | |
| EP | 3693676 | A1 * | 8/2020 | F24F 1/00 |
| JP | 63-254345 | | 10/1988 | |
| JP | S63254345 | A * | 10/1988 | |
| JP | 2000-9342 | | 1/2000 | |
| KR | 10-0315801 | | 11/2001 | |
| KR | 10-2014-0101284 | | 8/2014 | |
| KR | 10-1887066 | | 8/2018 | |

(Continued)

OTHER PUBLICATIONS

English translation of KR-20190053594-A, dated Jun. 14, 2024 (Year: 2024).*

(Continued)

*Primary Examiner* — Edelmira Bosques
*Assistant Examiner* — Brett Peterson Mallon
(74) *Attorney, Agent, or Firm* — STAAS & HALSEY LLP

(57) ABSTRACT

An air conditioner includes a housing including an inlet and an outlet, a heat exchanger arranged inside the housing to exchange heat with air sucked through the inlet, a fan configured to move air, which is heat-exchanged with the heat exchanger, to be discharged through the outlet, a motor configured to generate a rotational force, and a blade unit configured to guide air discharged to the outlet.

11 Claims, 24 Drawing Sheets

(56) References Cited

FOREIGN PATENT DOCUMENTS

| | | | | |
|---|---|---|---|---|
| KR | 10-2019-0027269 | | | 3/2019 |
| KR | 10-2019-0047415 | | | 5/2019 |
| KR | 10-2019-0052388 | | | 5/2019 |
| KR | 10-2019-0053594 | | | 5/2019 |
| KR | 20190052388 | A | * | 5/2019 |
| KR | 20190053594 | A | * | 5/2019 |
| KR | 10-2019-0106075 | | | 9/2019 |
| KR | 10-2019-0107784 | | | 9/2019 |
| KR | 10-2020-0075504 | | | 6/2020 |
| KR | 10-2249321 | | | 5/2021 |

OTHER PUBLICATIONS

English translation of KR-20190052388-A, dated Jun. 14, 2024 (Year: 2024).*
English translation of JP-S63254345-A, dated Jun. 14, 2024 (Year: 2024).*
International Search Report dated Jul. 22, 2022 for International Application No. PCT/KR2022/004557.
Written Opinion of the International Searching Authority dated Jul. 22, 2022 for International Application No. PCT/KR2022/004557.
Extended European Search Report dated May 23, 2024 for European Application No. 228422382.

* cited by examiner

AIR CONDITIONER

CROSS-REFERENCE TO RELATED APPLICATION(S)

This application is continuation application, under 35 U.S.C. § 111(a), of International Application No. PCT/KR2022/004557, filed on Mar. 31, 2022 which claims priority to Korean Patent Application No. 10-2021-0090975, filed on Jul. 12, 2021, in the Korean Intellectual Property Office, the disclosures of which are incorporated by reference herein in their entirety.

BACKGROUND

1. Field

The disclosure relates to an air conditioner, and more particularly, to an air conditioner including an improved structure provided to increase an air flow speed.

2. Description of Related Art

In general, an air conditioner is an apparatus that uses a refrigeration cycle to control temperature, humidity, airflow, etc. so as to be suitable for human activity and to remove dust in the air.

The air conditioner may include an indoor unit arranged indoors, an outdoor unit arranged outdoors, and a refrigerant pipe provided to connect the indoor unit to the outdoor unit and provided to circulate a refrigerant.

According to the installation location of the indoor unit, the air conditioner may be classified into a floor-standing air conditioner in which the indoor unit is placed on a floor, a wall-mounted air conditioner in which the indoor unit is installed on a wall, and a ceiling-mounted air conditioner in which the indoor unit is installed on a ceiling. The ceiling-mounted air conditioner is provided to be embedded in or suspended from a ceiling.

According to the direction of the airflow discharged from the indoor unit of the ceiling-mounted air conditioner, there is a difference in comfort felt by people in the room. For example, air discharged in a cooling operation goes down and thus the people may feel uncomfortable if the people directly face the air. Therefore, it is important to gradually control a temperature of the room by sending the air far away in the horizontal direction to prevent the air from falling directly downward. On the other hand, air discharged in a heating operation rises and thus people in a lower portion of the room may feel cold. Accordingly, it is important to send the discharged air farther down.

SUMMARY

Additional aspects will be set forth in part in the description which follows and, in part, will be apparent from the description, or may be learned by practice of the presented embodiments.

In accordance with an aspect of the disclosure, an air conditioner includes a housing including an inlet and an outlet, a heat exchanger arranged inside the housing to exchange heat with air suctioned through the inlet, a fan configured to move the air, which is heat-exchanged with the heat exchanger, to be discharged through the outlet, a motor configured to generate a rotational force, and a blade assembly configured to guide the air to the outlet and receive the rotational force from the motor. The blade assembly includes a main-blade configured to rotate in a first direction with respect to a first rotation center of the main-blade and adjust a discharge direction of the discharged through the outlet based on the rotational force received from the motor, and a sub-blade configured to rotate in a second direction opposite to the first direction, based on the rotation of the main-blade, to adjust a discharge speed of the air discharged through the outlet.

The blade assembly may further include a link provided to guide movement of the sub-blade to allow the sub-blade to rotate in the second direction. The link may include a first end rotatably couplable to the sub-blade, and a second end provided to form a second rotation center.

The sub-blade may include a first joint rotatably couplable to the main-blade, and a second joint rotatably couplable to the link.

An outlet flow path may be provided between the blower fan and the outlet. The housing may include a first guide member arranged adjacent to the inlet and a second guide member arranged to be outwardly spaced apart from the first guide member so as to form at least a portion of the outlet flow path. The outlet flow path may include a first outlet flow path formed between the blade assembly and the first guide member, and a second outlet flow path formed between the blade assembly and the second guide member.

In response to the rotation of the main-blade in the first direction, an area of the first outlet flow path may be reduced and an area of the second outlet flow path may be increased.

In a heating operation of the air conditioner, the main-blade may rotate in the first direction to guide the air, which is discharged through the outlet, toward a lower side, and the sub blade may rotate in the second direction to block the first outlet flow path.

The second joint may be positioned above the first joint.

The sub-blade may be rotatably couplable to an end close to the inlet of the main-blade to form an angle with the main-blade. In the heating operation of the air conditioner, an angle between the main-blade and the sub-blade may be 120° to 180°.

The link may rotate in the same direction as the main-blade in response to the second rotation center of the link being located in front of the first rotation center of the main-blade.

The link may rotate in a direction opposite to the main-blade in response to the second rotation center of the link being located behind the first rotation center of the main-blade.

The main-blade may include a first gear, and the sub-blade may include a second gear configured to rotate by meshing with the first gear according to the rotation of the main-blade.

The air conditioner may further include a hinge including a first coupler rotatably couplable to the first gear, and a second coupler rotatably couplable to the second gear, and a connecting rod including an end rotatably couplable to the hinge so as to rotate the hinge according to the rotation of the main-blade, and another end configured to rotate with respect to the second rotation center.

The link may include a curved shape.

The main-blade may further include a main-blade body, and a plurality of outlet holes penetrating the main-blade body. The aft may be discharged through plurality of outlet holes in response to closing the outlet by the main-blade.

The motor may include a stepper motor.

In accordance with another aspect of the disclosure, an air conditioner includes a housing body embedded in or suspended from a ceiling, a cover panel coupled to a lower side of the housing body and including an inlet and an outlet, a main-blade configured to rotate with respect to a first rotation center so as to adjust an opening and closing range of the outlet, a sub-blade configured to rotate in a direction, which is opposite to the main-blade, in accordance with the rotation of the main-blade, and a link configured to guide movement of the sub-blade to allow the sub-blade to rotate in the direction opposite to the main-blade.

The link may be provided to form a second rotation center by including one end rotatably coupled to the sub-blade and the other end rotatably coupled to the cover panel.

The sub-blade may include a first joint rotatably coupled to the main-blade, and a second joint rotatably coupled to the link. The second joint may be positioned above the first joint.

An outlet flow path, through which air directed to the outlet flows, may be formed inside the housing body. The main-blade and the sub-blade may partition the outlet flow path into a first outlet flow path and a second outlet flow path. The first outlet flow path may be arranged closer to the inlet than the second outlet flow path. In a heating operation of the air conditioner, the sub-blade may block the first outlet flow path.

The sub-blade may be rotatably coupled to one end, close to the inlet, of the main-blade to form an angle with the main-blade. In the heating operation of the air conditioner, an angle between the main-blade and the sub-blade may be 120° to 180°.

BRIEF DESCRIPTION OF THE DRAWINGS

The above and other aspects, features, and advantages of certain embodiments of the present disclosure will be more apparent from the following description taken in conjunction with the accompanying drawings of which.

DETAILED DESCRIPTION

Figure 1:
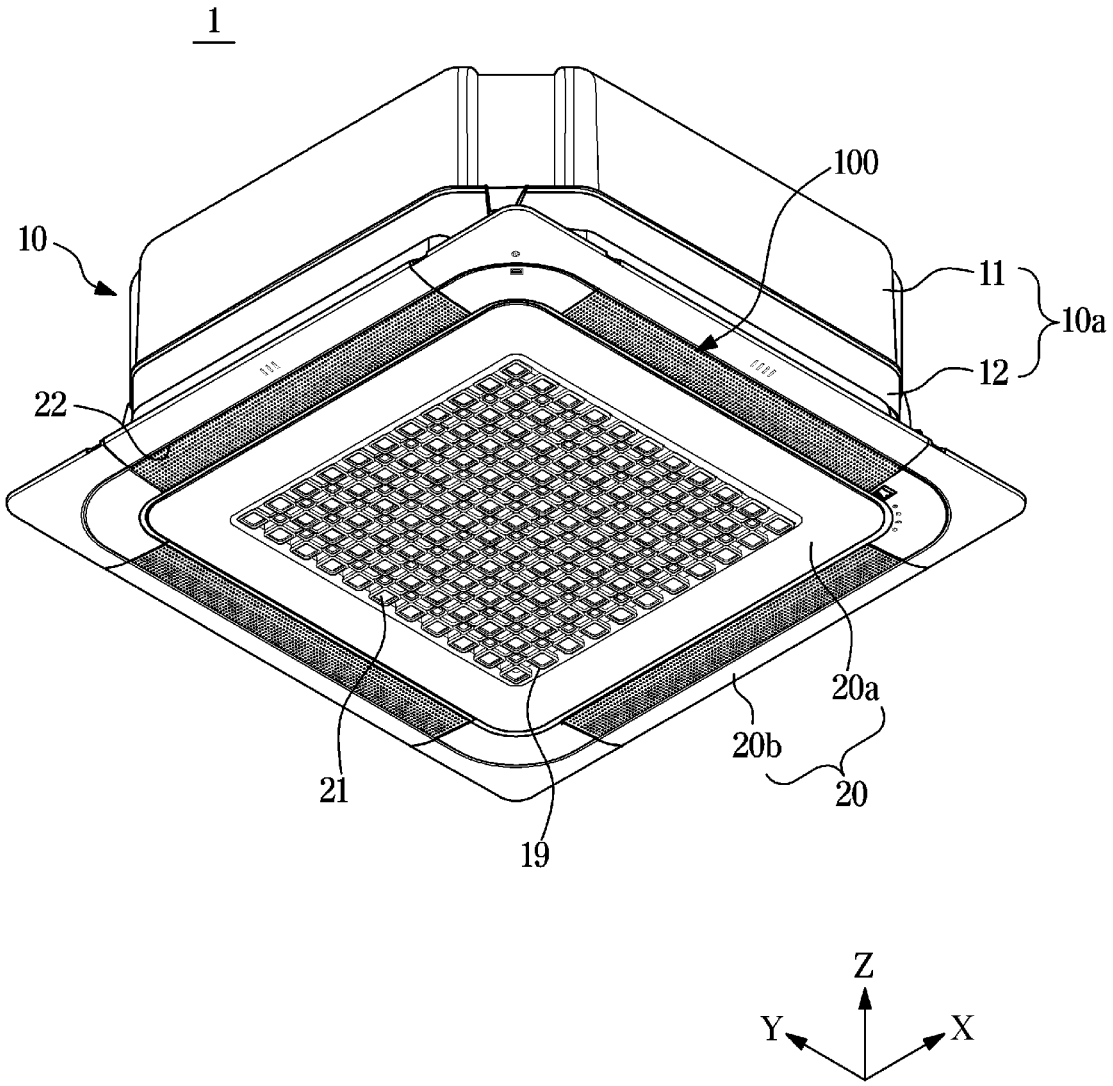
FIG. 1 is a perspective view illustrating an air conditioner according to an embodiment of the disclosure.

Embodiments described in the disclosure and configurations illustrated in the drawings are merely examples of the embodiments of the disclosure, and may be modified in various different ways at the time of filing of the present application to replace the embodiments and drawings of the disclosure.

In addition, the same reference numerals or signs illustrated in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms.

These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "up and down direction", "left and right direction", "front and rear direction", "upper portion", "lower portion", "upper side", "lower side", "front side", and "rear side" may be defined by the drawings, but the shape and the location of the component is not limited by the term.

Therefore, it is an aspect of the disclosure to provide an air conditioner capable of increasing a speed of air discharged from an outlet.

It is another aspect of the disclosure to provide an air conditioner capable of guiding air, which is discharged from an outlet, to reach a greater distance.

It is another aspect of the disclosure to provide an air conditioner capable of performing a cooling and/or heating operation to make a user feel comfortable.

For example, a direction toward a side far from an inlet may be defined as an outward direction, and a direction toward a side close to the inlet may be defined as an inward direction. In addition, a direction, from which air is discharged, on an outlet may be defined as a front, and a direction opposite to the front side may be defined as a rear. Particularly, with reference to FIG. 2, the front may be understood as a +X direction and the rear as a −X direction. However, the disclosure is not limited thereto, and the direction may vary according to a mounting position of a blade unit.

A refrigeration cycle forming an air conditioner is composed of a compressor, a condenser, an expansion valve, and an evaporator. The refrigeration cycle may circulate a series of processes composed of compression-condensation-expansion-evaporation, and the refrigeration cycle may be configured to supply air that is heat-exchanged with a refrigerant.

The compressor compresses refrigerant gas into a high-temperature and high-pressure state, and discharges the high-temperature and high-pressure refrigerant gas. The discharged refrigerant gas is introduced into the condenser. The condenser condenses the compressed refrigerant into a liquid phase and releases heat to the surroundings through a condensation process.

The expansion valve expands the high-temperature and high-pressure liquid refrigerant, which is condensed by the condenser, into a low-pressure liquid refrigerant. The evaporator evaporates the refrigerant, which is expanded in the expansion valve, and returns the low-temperature and low-pressure refrigerant gas to the compressor. Through this cycle, the air conditioner may adjust a temperature of an indoor space.

An outdoor unit of an air conditioner refers to a part of the refrigeration cycle composed of a compressor and an outdoor heat exchanger. An indoor unit of an air conditioner includes an indoor heat exchanger, and an expansion valve may be located in either an indoor unit or an outdoor unit. An indoor heat exchanger and an outdoor heat exchanger serve as a condenser or an evaporator. When the indoor heat exchanger is used as the condenser, the air conditioner operates as a heater, and when the indoor heat exchanger is used as the evaporator, the air conditioner operates as a cooler.

Hereinafter embodiments according to the disclosure will be described in detail with reference to the accompanying drawings.

In the following, for convenience of description, the indoor unit of a ceiling-mounted air conditioner will be described as an example. However, a blade according to an embodiment of the disclosure may be applied to an indoor unit of different type air conditioners such as an indoor unit of a floor-standing air conditioner and an indoor unit of a wall-mounted air conditioner.

Figure 2:
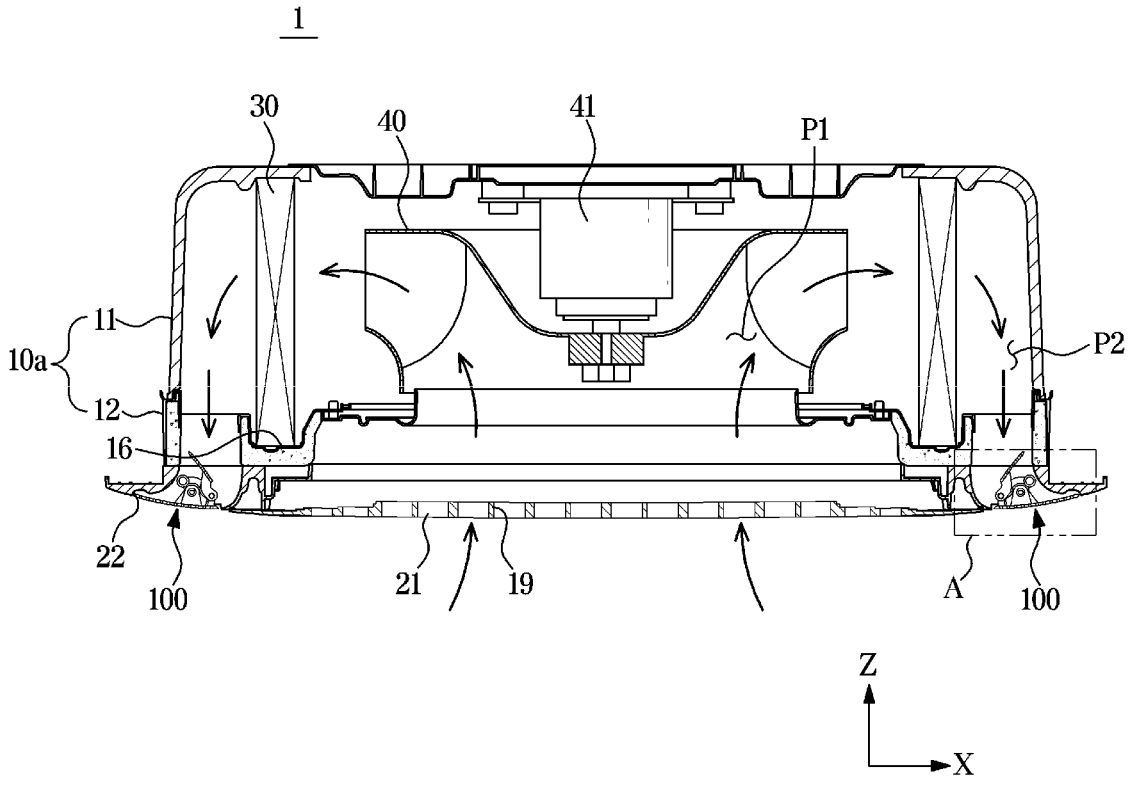
FIG. 2 is a side sectional view illustrating the air conditioner according to an embodiment of the disclosure.
Figure 3:
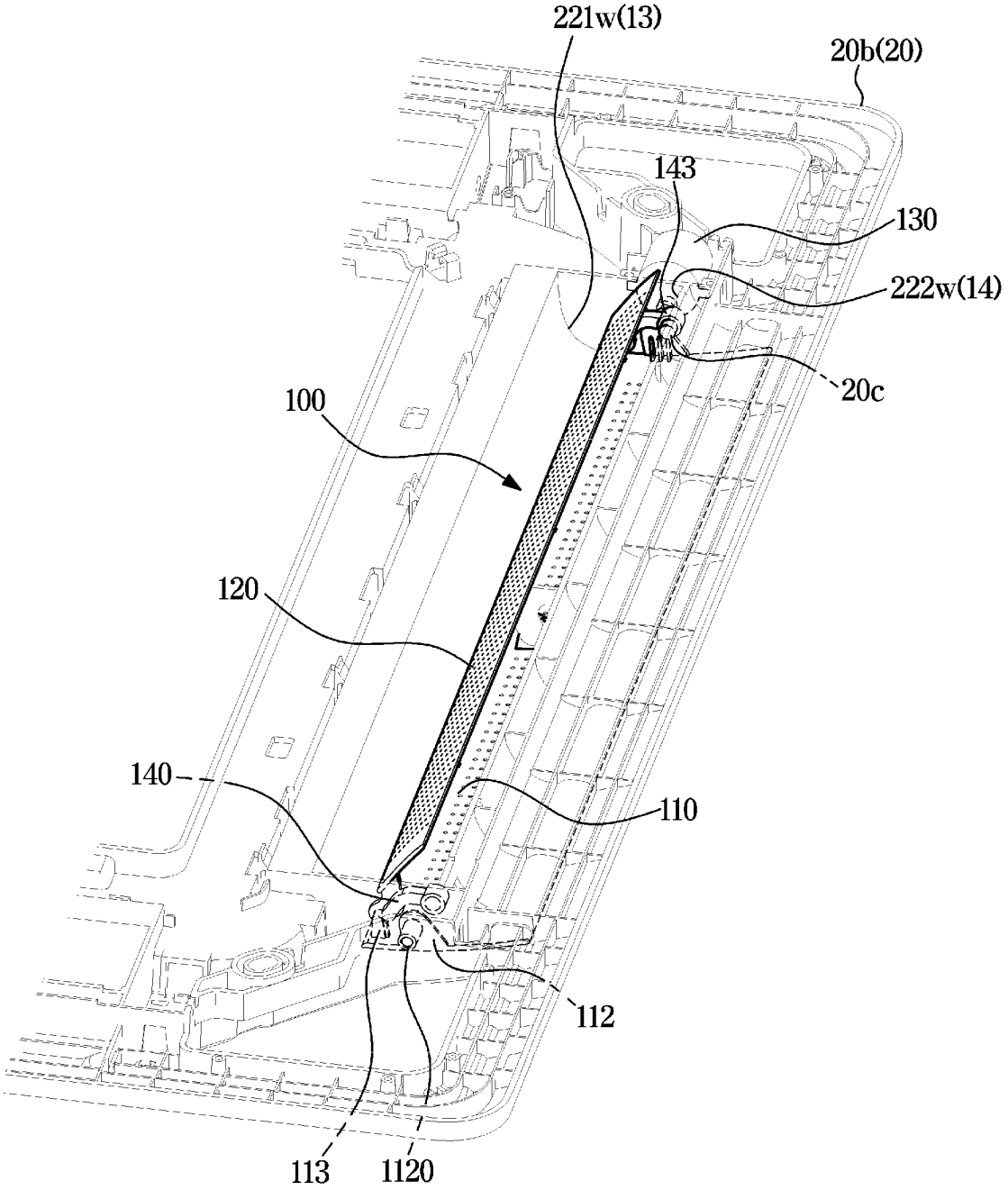
FIG. 3 is a view schematically illustrating a coupling relationship between a cover panel and a blade unit of the air conditioner shown in FIG. 1.

FIG. 1 is a perspective view illustrating an air conditioner according to an embodiment of the disclosure. FIG. 2 is a side sectional view illustrating the air conditioner according to an embodiment of the disclosure. FIG. 3 is a view schematically illustrating a coupling relationship between a cover panel and a blade unit of the air conditioner shown in FIG. 1.

Referring to FIGS. 1 and 2, an air conditioner 1 according to an embodiment may include a housing 10.

The housing 10 may be installed on a ceiling (not shown). For example, the housing 10 may be embedded in the ceiling or suspended from the ceiling. The air conditioner 1 may be provided in a 4-way type (i.e., 4 way cassette type). However, the disclosure is not limited thereto, and the air conditioner 1 may be provided as an air conditioner in a 1-way type. Hereinafter 4-way type air conditioner will be described as an example.

The housing 10 may accommodate components of the air conditioner 1 therein. In the housing 10, a heat exchanger 30 configured to exchange heat between air sucked through an inlet 21 and a refrigerant, a blower fan 40 (also referred to as a fan 40) configured to forcibly move air, and a control unit (not shown) configured to control operation of the air conditioner 1. The housing 10 may include a substantially box shape.

The housing 10 may include a housing body 10*a*. The housing body 10*a* may form an exterior of the air conditioner 1. For example, the housing body 10*a* may include a first housing 11 and a second housing 12 coupled to a lower portion of the first housing 11.

The housing 10 may include the inlet 21 provided to allow indoor air to be sucked into the housing 10 and an outlet 22 provided to allow the heat-exchanged air to be discharged back into an indoor space.

For example, the housing 10 may include a cover panel 20 formed in a lower portion of the housing 10, and the inlet 21 and the outlet 22 are arranged in the cover panel 20. The cover panel 20 may include a first panel 20*a* provided with the inlet 21 and a second panel 20*b* provided with the outlet 22. The first panel 20*a* and the second panel 20*b* may be provided as separate components and assembled with each other. However, the disclosure is not limited thereto, and the first panel 20*a* and the second panel 20*b* may be integrally formed with each other.

The cover panel 20 may be provided to be coupled to a lower portion of the second housing 12. A lower surface of the cover panel 20 may be exposed to the lower side of the ceiling. The cover panel 20 may include a substantially plate shape.

The inlet 21 may be provided at a lower center of the housing 10. The outlet 22, through which air is discharged, may be provided at an outer side of the inlet 21.

A grille 19 may be provided at the lower center of the housing 10 to filter out dust from the air sucked through the inlet 21.

The outlet 22 may be formed adjacent to each edge so as to correspond to a lower periphery of the housing 10. For example, four outlets 22 may be provided. Two outlets 22 may be formed in the X-axis direction and two outlets 22 may be formed in the Y-axis direction. The four outlets 22 may be arranged to discharge air to all four sides of the room, respectively. However, the disclosure is not limited thereto, and one or more outlets may be provided according to the type of the air conditioner 1.

The air conditioner 1 may suck air from the lower side, cool or heat the sucked air, and then discharge the cooled or heated air to the lower side again.

An inlet flow path P1 and an outlet flow path P2 may be formed inside the housing 10. The inlet flow path P1, through which air sucked through the inlet 21 flows, may be arranged between the inlet 21 and the blower fan 40, and the outlet flow path P2, through which air discharged by the blower fan 40 flows, may be arranged between the blower fan 40 and the outlet 22. Particularly, the air heat-exchanged with the heat exchanger 30 may flow along the outlet flow path P2 and be discharged into the indoor space through the outlet 22.

Referring to FIG. 3, the housing 10 may include a first guide member 13 and a second guide member 14 which form at least a part of the outlet flow path P2. The first guide member 13 may be provided adjacent to the inlet, and the second guide member 14 may be provided to be outwardly spaced apart from the first guide member 13. For example, the first guide member 13 may include a first inner wall 121*w* of the second housing 12 and a first inner wall 221*w* of the second panel 20*b* extending in accordance with an end of the first inner wall 121*w* (refer to FIG. 7). The second guide member 14 may include a second inner wall 122*w* of the second housing 12 and a second inner wall 222*w* of the second panel 20*b* extending in accordance with an end of the second inner wall 122*w* (refer to FIG. 7). The end of the first guide member 13 and the end of the second guide member 14 may form the outlet 22. Particularly, the end of the first inner wall 221*w* of the second panel 20*b* and the end of the second inner wall 222*w* of the second panel 20*b* may form the outlet 22.

The first guide member 13 may extend outwardly. The first guide member 13 may include a curved shape. A first opening 17 may be formed between the first guide member 13 and a first side 110*a* of a main-blade 110 of a blade unit 100 (also referred to as a blade assembly 100) to be described later. The first side 110*a* of the main-blade 110 may be one side adjacent to the inlet 21 of the main-blade body 111. An opening degree of the first opening 17 may vary according to a rotation range of the main-blade 110.

The second guide member 14 may extend outwardly. The second guide member 14 may include a curved shape. A second opening 18 may be formed between the second guide member 14 and a second side 110*b* of the main-blade 110. The second side 110*b* of the main-blade 110 may be one side far from the inlet 21 of the main-blade body 111 as a side opposite to the first side 110*a*. An opening degree of the second opening 18 may vary according to the rotation range of the main-blade 110.

The outlet flow path P2 may include a first outlet flow path P21 and a second outlet flow path P22. The first outlet flow path P21 and the second outlet flow path P22 may be formed by the rotation of the blade unit 100. Particularly, the main-blade 110 and a sub-blade 120 of the blade unit 100 may be provided to partition at least a portion of the outlet flow path P2 into the first outlet flow path P21 and the second outlet flow path P22. For example, the first outlet flow path P21 may be formed between the blade unit 100 and the first guide member 13, and the second outlet flow path P22 may be formed between the blade unit 100 and the second guide member 14. With respect to the direction in which the air is discharged, the first outlet flow path P21 may be provided at the rear of the blade unit 100, and the second outlet flow path P22 may be provided at the front of the blade unit 100. The first outlet flow path P21 may be arranged closer to the inlet 21 than the second outlet flow path P22.

An area of the first outlet flow path P21 and an area of the second outlet flow path P22 may vary according to the rotation of the blade unit 100. For example, as the main-blade 110 of the blade unit 100 to be described later rotates in a first direction R1, the area of the first outlet flow path P21 may be reduced, and the area of the second outlet flow path P22 may be increased.

In the housing 10, the heat exchanger 30 may be arranged on the outer side of the blower fan 40. The heat exchanger 30 may include a quadrangular annular shape. However, the heat exchanger 30 is not limited to a quadrangular annular shape, and may be provided in various shapes such as a circle, an oval, or a polygon.

The heat exchanger 30 may be seated inside the second housing 12. Particularly, the heat exchanger 30 may be placed on a drain tray 16 formed inside the second housing 12. Condensed water generated in the heat exchanger 30 may be collected in the drain tray 16. The drain tray 16 may be provided in a shape corresponding to the shape of the heat exchanger 30. For example, based on the heat exchanger 30 including a quadrangular annular shape, the drain tray 16 may also include a quadrangular annular shape, and based on the heat exchanger 30 including a circular shape, the drain tray 16 may also include a circular shape.

The blower fan 40 may be arranged in a central portion of the housing 10. The blower fan 40 may be provided on an inner side of the heat exchanger 30. The blower fan 40 may be a centrifugal fan configured to suck air in an axial direction and discharge the sucked air in a radial direction. A blower motor 41 configured to drive the blower fan 40 may be provided in the air conditioner 1.

Figure 4:
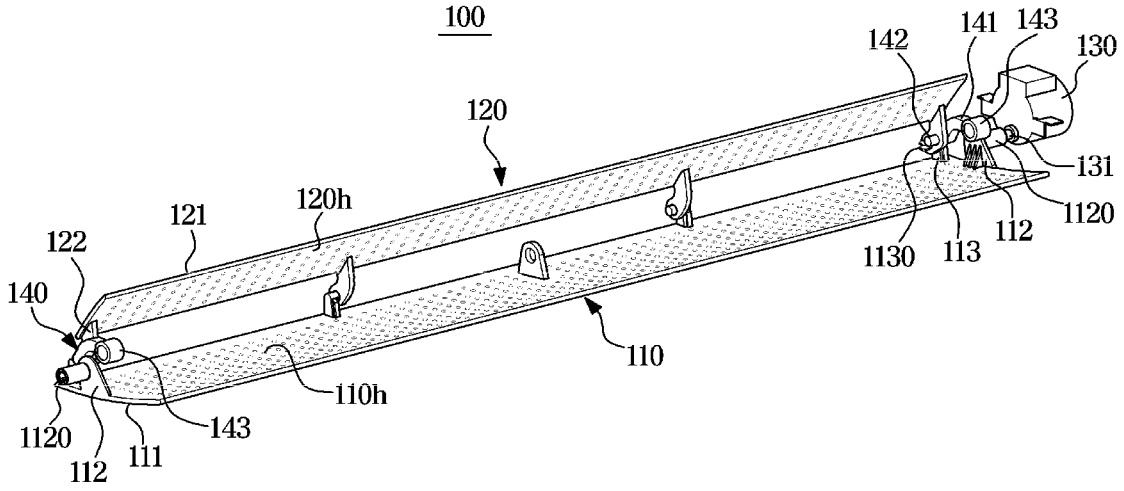
FIG. 4 is a view illustrating the blade unit of the air conditioner shown in FIG. 1.
Figure 5:
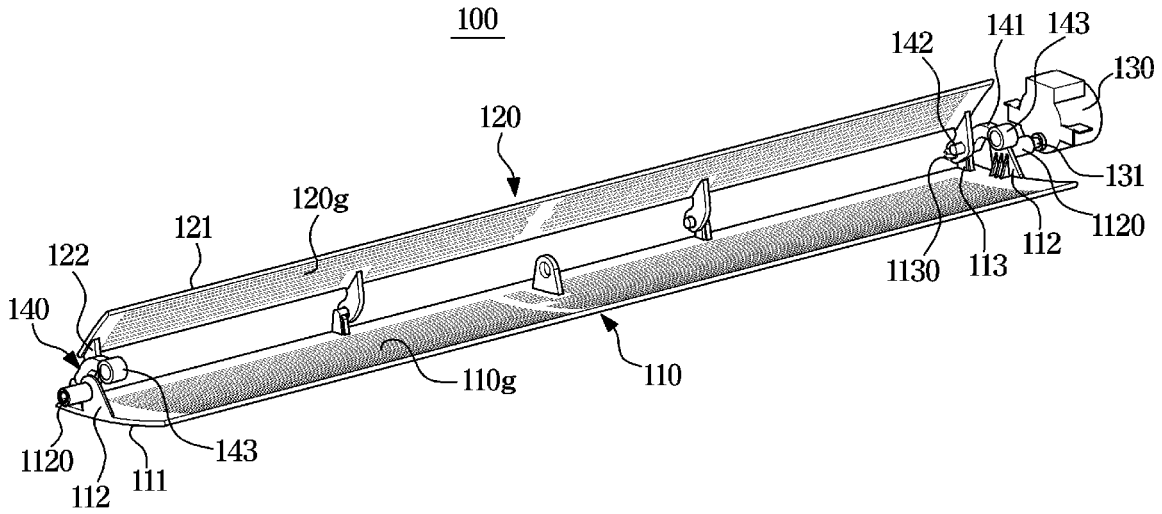
FIG. 5 is a view illustrating a modified embodiment of the blade unit shown in FIG. 4.
Figure 6:
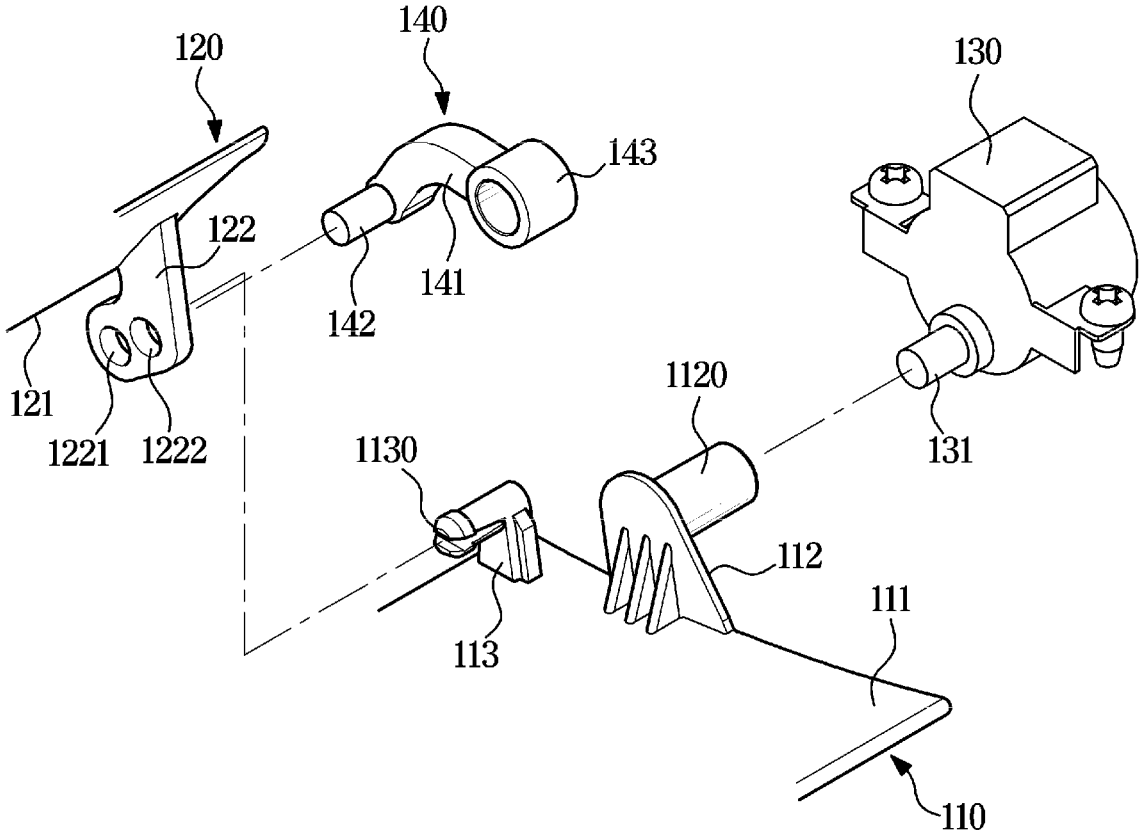
FIG. 6 is an exploded view illustrating the blade unit shown in FIG. 4.
Figure 7:
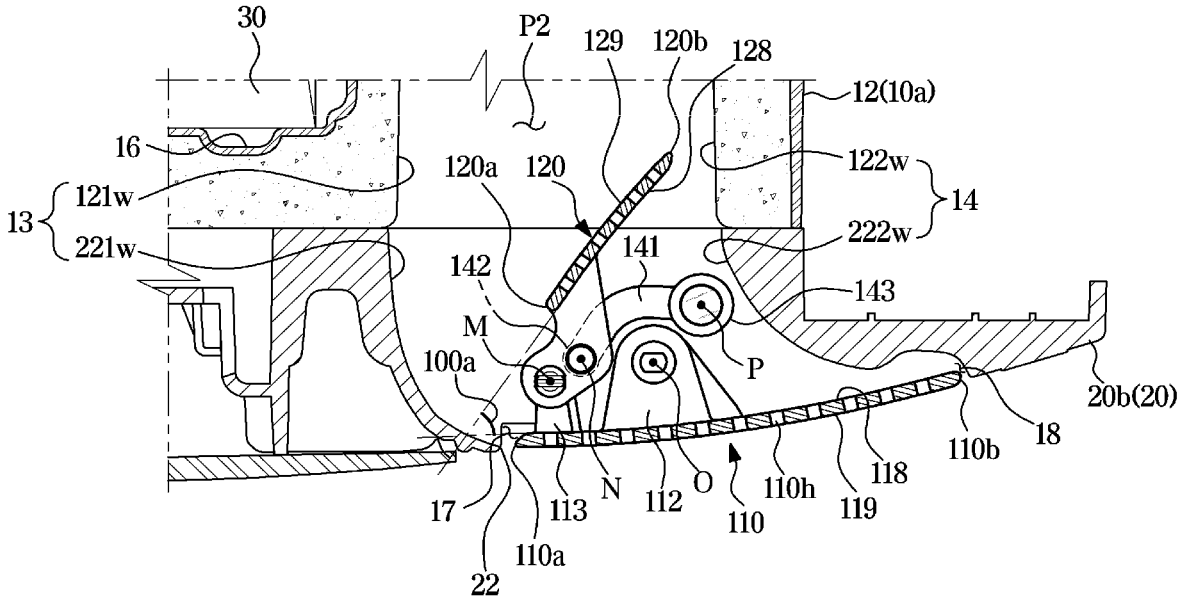
FIG. 7 is an enlarged view illustrating a part A shown in FIG. 2.
Figure 8:
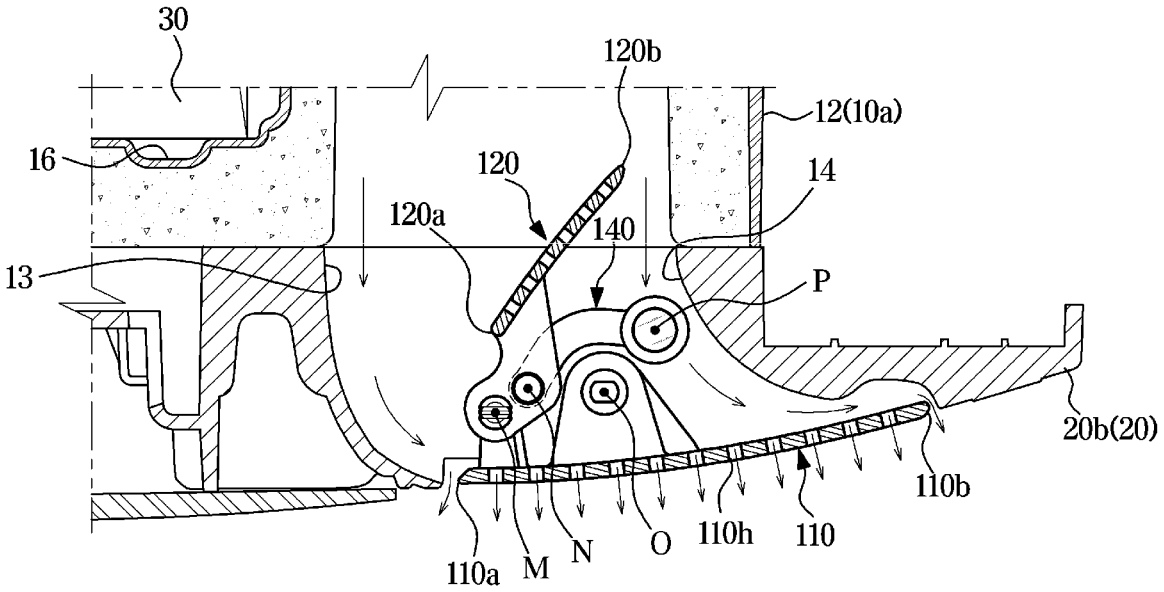
FIG. 8 is a view schematically illustrating a windless operation of the blade unit shown in FIG. 7.
Figure 9:
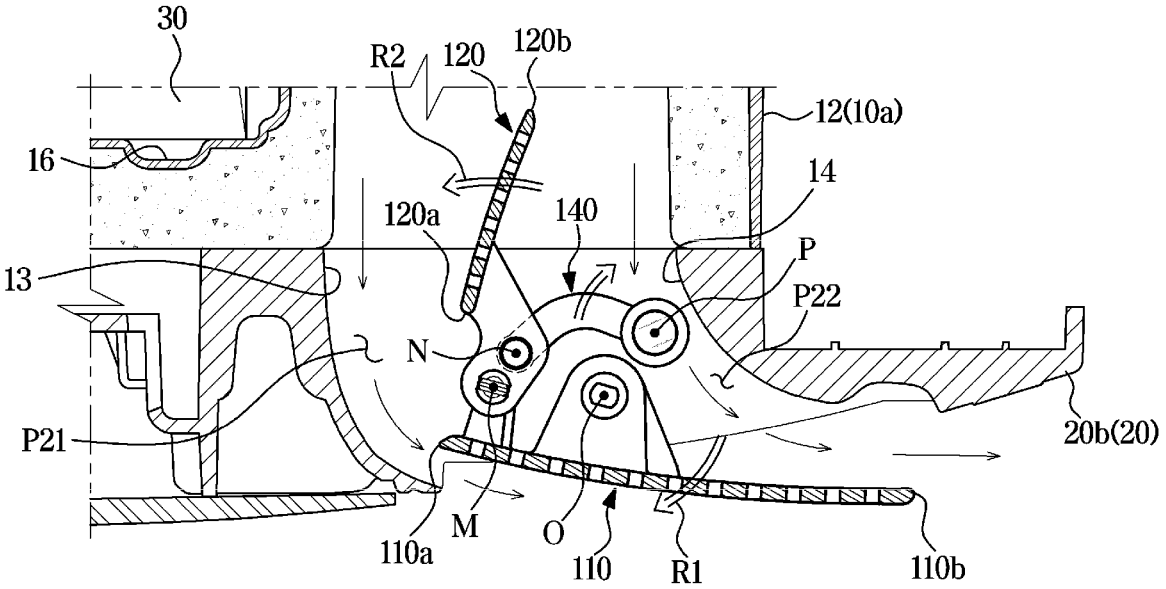
FIG. 9 is a view schematically illustrating a cooling operation of the blade unit shown in FIG. 7.
Figure 10:
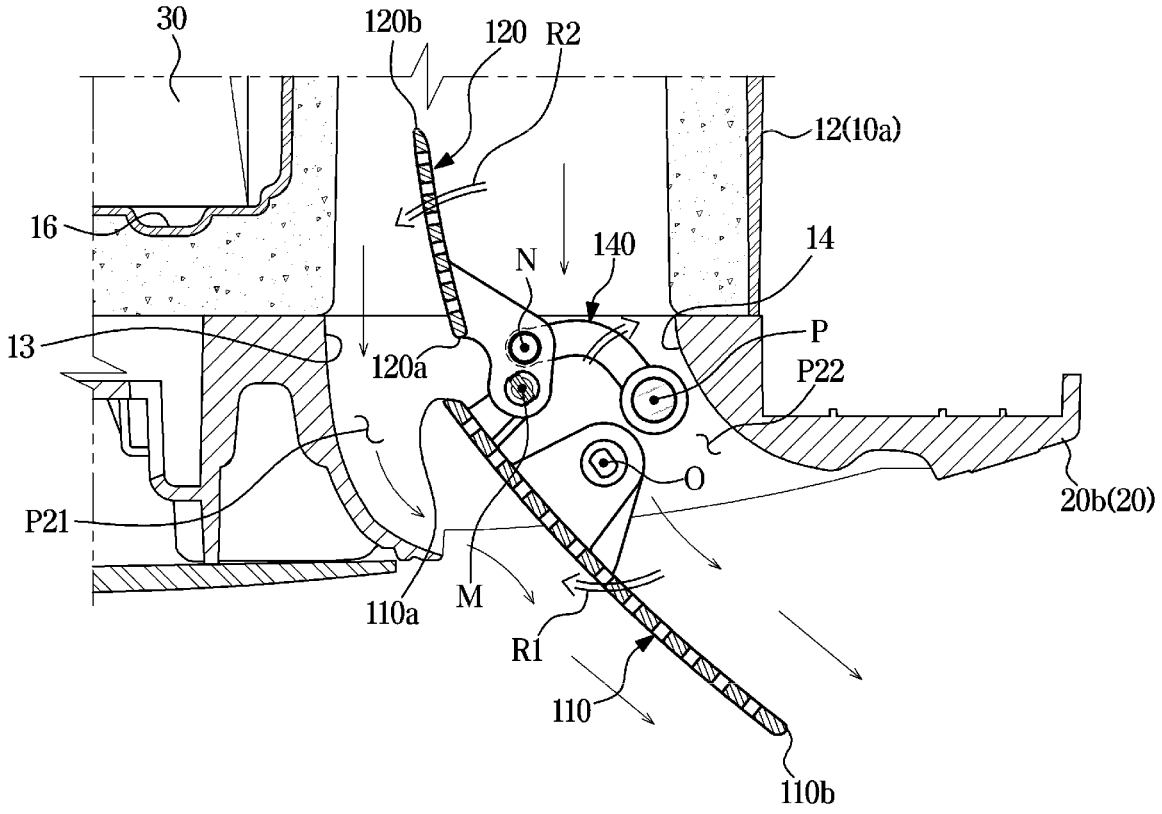
FIG. 10 is a view schematically illustrating a heating operation of the blade unit shown in FIG. 7.
Figure 11:
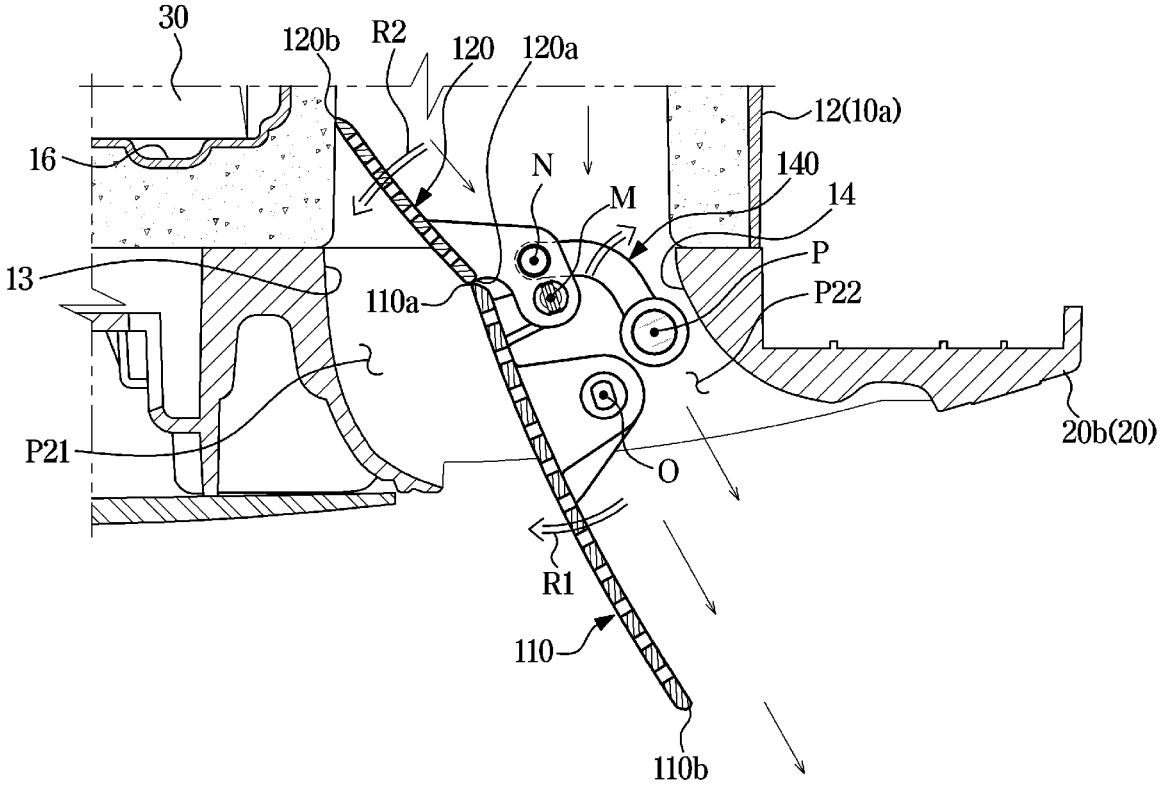
FIG. 11 is a view schematically illustrating a high-speed operation of the blade unit shown in FIG. 7.

FIG. 4 is a view illustrating the blade unit of the air conditioner shown in FIG. 1. FIG. 5 is a view illustrating a modified embodiment of the blade unit shown in FIG. 4. FIG. 6 is an exploded view illustrating the blade unit shown in FIG. 4. FIG. 7 is an enlarged view illustrating a part A shown in FIG. 2. FIG. 8 is a view schematically illustrating a windless operation of the blade unit shown in FIG. 7. FIG. 9 is a view schematically illustrating a cooling operation of the blade unit shown in FIG. 7. FIG. 10 is a view schematically illustrating a heating operation of the blade unit shown in FIG. 7. FIG. 11 is a view schematically illustrating a high-speed operation of the blade unit shown in FIG. 7.

The air conditioner 1 may include the blade unit 100. The blade unit 100 may be arranged to correspond to the outlet 22. The blade unit 100 may guide the air discharged through the outlet 22. The blade unit 100 may be configured to open and close the outlet 22. The blade unit 100 may be assembled to the second panel 20*b* of the cover panel 20. Meanwhile, the blade unit 100 may be referred to as a blade assembly 100.

The blade unit 100 may be configured to rotate. The blade unit 100 may be configured to rotate within a predetermined angle range on the outlet 22.

Referring to FIGS. 4 to 6, the blade unit 100 may include the main-blade 110 and the sub-blade 120.

A motor 130 may be connected to an end of the main-blade 110. In the drawings, it is illustrated that the motor 130 is connected to only one end of the main-blade 110, but is not limited thereto. The motor 130 may be connected to opposite ends of the main-blade 110. The motor 130 may generate a rotational force and transmit the rotational force to the main-blade 110. The motor 130 may include a rotation shaft 131 provided to transmit a rotational force to the main-blade 110. The main-blade 110 may rotate about the rotation shaft 131. That is, the rotation shaft 131 may be provided to form a first rotation center O of the main-blade 110.

For example, the motor 130 may include a stepper motor. The motor 130 may be a variable reluctance type stepper motor having excellent rotation angle resolution. The motor 130 may freely implement a swing mode that requires a continuous direction change of the main-blade 110 as well as a stepwise change of direction of the main-blade 110. However, the disclosure is not limited thereto, and various power devices configured to implement the direction change of the main-blade 110 may be used.

The main-blade 110 may be provided to adjust the discharge direction of the air discharged to the outlet 22. The main-blade 110 may be configured to rotate in the first direction R1 with respect to the first rotation center O by receiving the rotational force from the motor 130.

The main-blade 110 may include the main-blade body 111, a motor coupler 112, and a sub-blade coupler 113.

The main-blade body 111 may guide the air discharged through the outlet 22. The main-blade body 111 may include a substantially plate shape. For example, the main-blade body 111 may be provided in a rectangular shape including a pair of long sides and a pair of short sides.

The motor coupler 112 may be coupled to the motor 130. Particularly, the motor coupler 112 may be connected to the rotation shaft 131 to receive the rotational force from the motor 130. The main-blade 110 may rotate with respect to the first rotation center O formed by the rotation shaft 131. The motor coupler 112 may extend upwardly from the main-blade body 111.

The sub-blade coupler 113 may be coupled to the sub-blade 120. The sub-blade coupler 113 may be arranged closer to the inlet 21 than the motor coupler 112. The sub-blade coupler 113 may extend upwardly from the main-blade body 111.

As illustrated in FIG. 4, the main-blade 110 may include a plurality of outlet holes 110*h* penetrating the main-blade body 111. The air passing through the outlet 22 through the plurality of outlet holes 110*h* may be discharged to the outside of the housing 10. The plurality of outlet holes 110*h* may be distributed to be spaced apart from each other at regular intervals, but the disclosure is not limited thereto. Therefore, the outlet holes may be distributed concentrated on a specific region of the main-blade body 111. In addition, as illustrated in FIG. 5, the main-blade 110 may include a grille 110*g* penetrating the main-blade body 111.

Alternatively, the main-blade 110 may not include the plurality of outlet holes 110*h* or the grille 110*g*. That is, the main-blade 110 may include the main-blade body 111 that is not penetrated by the plurality of outlet holes 110*h* or the grille 110*a*.

The sub-blade 120 may be provided to interlock with the rotation of the main-blade 110. The sub-blade 120 may be rotatably coupled to the main-blade 110. According to the rotation of the main-blade 110, the sub-blade 120 may rotate in the second direction R2 opposite to the first direction R1. The sub-blade 120 may be arranged closer to the heat exchanger 30 than the main-blade 110. The sub-blade 120 may be located above the main-blade 110.

The sub-blade 120 may be configured to adjust a discharge speed of the air discharged through the outlet 22. For example, the sub-blade 120 may be provided to block a part of the outlet flow path P2. The sub-blade 120 may block a part of the outlet flow path P2 to reduce an area of the flow path, through which air is discharged, thereby increasing the speed of the air discharged through the outlet 22. As a result, the air may be discharged through the outlet 22 at a high speed, and thus the air may reach a greater distance.

The sub-blade 120 may include a sub-blade body 121 and a connector 122 provided for connection with other components.

The sub-blade body 121 may be arranged on the outlet flow path P2. The sub-blade body 121 may guide the air flowing on the outlet flow path P2. The sub-blade body 121 may smooth or block the flow of air flowing on the outlet flow path P2, thereby controlling the discharge direction of the air, the discharge speed of the air, and the like.

The sub-blade body 121 may include a substantially plate shape. For example, the sub-blade body 121 may be provided in a rectangular shape including a pair of long sides and a pair of short sides. With respect to FIGS. 7 and 8, that is, based on the case in which the blade unit 100 is in a first position, a first side 120*a* of the sub-blade body 121 may correspond to one side that is close to the inlet 21 and a second side 120*b* may correspond to a side that is far from the inlet 21 and opposite to the first side 120*a*.

The connector 122 may extend from the sub-blade body 121. For example, the connector 122 may extend downwardly from the sub-blade body 121. The connector 122 may extend downwardly from the one side 120*a*, close to the inlet 21, of the sub-blade body 121.

The sub-blade 120 may include a first joint M rotatably coupled to the main-blade 110 and a second joint N rotatably coupled to a link 140 to be described later. For example, referring to FIG. 6, the first joint M may include a first coupling hole 1221, and the first coupling hole 1221 may be rotatably coupled to a protrusion 1130 of the sub-blade coupler 113 of the main-blade 110. The second joint N may include a second coupling hole 1222, and the second coupling hole 1222 may be rotatably coupled to one end 142 of the link 140. The first joint M and the second joint N may be formed in the connector 122 of the sub-blade 120.

The first joint M may mean a coupler between the main-blade 110 and the sub-blade 120, and the second joint N may mean a coupler between the sub-blade 120 and the link 140.

The second joint N may be positioned above the first joint M. With this arrangement structure, the sub-blade 120 may rotate in the opposite direction to the main-blade 110. That is, the sub-blade 120 may rotate in the second direction R2.

With respect to FIG. 7, the main-blade 110 may include a first surface 118 facing the sub-blade 120 and a second surface 119 opposite to the first surface 118. The sub-blade 120 may include a third surface 128 facing the main-blade 110 and a fourth surface 129 opposite to the third surface 128. Hereinafter for convenience of description, an angle between the first surface 118 of the main-blade 110 and the third surface 128 of the sub-blade 120 may be referred to as a blade angle 100*a*. The blade angle 100*a* may be changed by the rotation of the main-blade 110 and the rotation of the sub-blade 120 interlocking with the main-blade 110. Particularly, in response to the rotation of the main-blade 110 in the first direction R1, the sub-blade 120 may rotate in the second direction R2, and thus the blade angle 100*a* may be gradually increased. Particularly, in a high-speed operation to be described later, the blade angle 100*a* may be the maximum angle. For example, in order for the sub-blade 120 to block the first outlet flow path P21 (i.e., the rear flow path) to reduce the area of the flow path, the maximum angle of the blade angle 100*a* may be in a range of approximately 120° to 180°. However, the angle is not limited thereto, and the blade angle 100*a* may be provided to be approximately 180° or more (refer to FIG. 11) according to the arrangement configuration or coupling relationship of the blade unit 100.

The sub-blade 120 may include a plurality of outlet holes 120*h* penetrating the sub-blade body 121. The air passing through the outlet 22 through the plurality of outlet holes 120*h* may be discharged to the outside of the housing 10. The plurality of outlet holes 120*h* may be distributed to be spaced apart from each other at regular intervals, but the disclosure is not limited thereto. Therefore, the plurality of outlet holes 120*h* may be distributed concentrated in a specific region of the sub-blade body 121. Alternatively, the sub-blade 120 may include a grille 120*g* penetrating the sub-blade body 121.

Alternatively, the sub-blade 120 may not include the plurality of outlet holes 120*h* or the grille. That is, the sub-blade 120 may include the sub-blade body 121 that is not penetrated by the plurality of outlet holes 120*h* or the grille.

The blade unit 100 may further include the link 140 provided to guide the movement of the sub-blade 120 to allow the sub-blade 120 to rotate in the second direction R2.

The link 140 may include a link body 141. The link 140 may include the one end 142 coupled to the sub-blade 120 and the other end 143 provided to form a second rotation center P. For example, the one end 142 may be rotatably coupled to the second coupling hole 1222 of the sub-blade 120. The other end 143 may be rotatably mounted to an inner surface 20*c* of the cover panel 20. The one end 142 of the link 140 may be referred to as a first end 142, and the other end 143 of the link 140 may be referred to as a second end 143.

According to the embodiment, the second rotation center P of the link 140 may be located in front of the first rotation center O of the main-blade 110. That is, the first rotation center O may be arranged adjacent to the inlet 21 than the second rotation center P. The blade unit 100 including the arrangement relationship may be referred to as a front type. However, the disclosure is not limited thereto, and the second rotational center P of the link 140 may be arranged at the rear of the first rotation center O of the main-blade 110, and the blade unit including the arrangement relationship may be referred to as a rear type. Details of such a rear-type blade unit will be described later.

The link 140 may include a curved shape. For example, the link body 141 may include a curved shape. Accordingly, the link 140 may avoid interference with the main-blade 110 and/or the sub-blade 120. Particularly, the link 140 may avoid interference with the sub-blade coupler 113 of the main-blade 110 and/or the connector 122 of the sub-blade 120. For example, in response to the rotation of the main-blade 110 in the first direction R1, the coupling portion between the main-blade 110 and the sub-blade 120 may move along the curved shape of the link body 141.

Hereinafter operation of the blade unit 100 will be described with reference to FIGS. 7 to 11.

The main-blade 110 may receive the rotational force from the motor 130 to rotate in the first direction R1. According to the rotation of the main-blade 110, the sub-blade 120 and the link 140 may rotate in accordance with the rotation of the main-blade 110. Particularly, in response to the rotation of the sub-blade coupler 113 in the first direction R1, the first joint M of the sub-blade 120 coupled to the sub-blade coupler 113 may also rotate in the first direction R1. The first joint M may move forward and upward while rotating in the first direction R1. In response to the movement of the first joint M, the link 140 connected to the second joint N may also rotate in accordance with the movement thereof. Based on the second rotation center P of the link 140 being located in front of the first rotation center O of the main-blade 110 (i.e., in the front type), the link 140 may rotate in the same direction as the main-blade 110 (the first direction R1) with respect to the second rotation center P. As a result, the connector 122 of the sub-blade 120 may be lifted by the movement of the main-blade 110 and the link 140. Accordingly, the other side 120*b* of the sub-blade 120 corresponding to a free end may move backward.

In summary, by the rotation of the main-blade 110 in the first direction R1, the sub-blade 120 may rotate in the second direction R2. As illustrated in FIG. 11, the sub-blade 120 may block the rear of the outlet flow path P2 while rotating in the second direction R2. That is, the sub-blade 120 may block the first outlet flow path P21 of the outlet flow path P2. Accordingly, the heat-exchanged air may be discharged toward the outlet 22 through the second outlet flow path P22.

In general, in a heating operation, because the temperature of the discharged air is high, the discharged air has an airflow that rises due to the convection. Accordingly, the upper side of the room is easily heated by the influence of the discharged-warm air, but it is difficult to heat the lower side of the room because the lower side of the room is not affected by the discharged-warm air. In other words, due to the updraft, it may be difficult for the discharged air to reach the floor of the room. Particularly, in the case of a room with a high ceiling, heating efficiency may be very low, and a separate component (e.g., a kit for high-ceiling) may be required to increase heating efficiency.

However, according to the disclosure, the blade unit 100 may guide the discharged air to reach a greater distance at a high speed during the heating operation. Particularly, as illustrated in FIG. 11, the main-blade 110 may rotate in the first direction to guide the air, which is discharged through the outlet 22, toward a lower side as much as possible, and the sub-blade 120 may rotate in the second direction R2 to block the first outlet flow path P21. Accordingly, the discharged air may be discharged through only the second outlet flow path P22 without passing through the first outlet flow path P21. That is, because the discharged air is discharged through the flow path including a relatively small area, the discharge speed may be increased. As a result, the air discharged through the outlet 22 may be discharged at a high speed and reach a greater distance. That is, during the heating operation, the discharged air may reach the floor of the room, and thus the entire room may be evenly heated and the heating efficiency may be significantly improved. However, the disclosure is not limited thereto, and the sub-blade 120 may be arranged to block the first outlet flow path P21 for rapid cooling even during a cooling operation.

Hereinafter an operation mode of the air conditioner 1 will be described with reference to FIGS. 7 to 11.

The blade unit 100 may rotate within a predetermined angle range to discharge air in various ways. For example, the blade unit 100 may rotate between the first position in which the air conditioner 1 is in an off-state (refer to FIG. 7) or in a windless operation (refer to FIG. 8) and a second position in which the air conditioner 1 is in the high-speed operation.

For convenience of description, it is assumed that when the blade unit 100 is in the first position, the main-blade 110, the sub-blade 120, and the link 140 which are components of the blade unit 100 to be described later are also in the first position. It is assumed that when a blade unit 100 is in the second position, the main-blade 110, the sub-blade 120, and the link 40, which are components of the blade unit 100 to be described later, are also in the second position.

As illustrated in FIG. 7, in response to the off-state of the air conditioner 1, the air conditioner 1 may be in a state in which the cooling and/or heating operation is not performed. For example, in response to the off-state of the air conditioner 1, the blade unit 100 may close the outlet 22. The term "close" may not mean that the blade unit 100 completely closes the outlet 22 so as not to communicate with the outside, but it is understood that the main-blade body 111 of the main-blade 110 covers the outlet 22.

As illustrated in FIG. 8, in the windless operation of the air conditioner 1, the blade unit 100 may allow the air to be discharged to the outside of the housing through the plurality of outlet holes 110*h* of the main-blade 110 and/or the openings 17 and 18 while closing the outlet 22. The windless operation may refer to a low air volume operation in which air is discharged at a predetermined speed or less without directly blowing air to the user. For example, based on the main-blade 110 including the grille 110*g*, the blade unit 100 may discharge air to the outside of the housing 10 through the grille 110*g* and/or the openings 17 and 18. Alternatively, based on the main-blade 110 excluding the plurality of outlet holes 110*h* and the grille 110*g* that is the main-blade body 111 is not penetrated, the blade unit 100 may discharge air to the outside of the housing 10 through the openings 17 and 18. Hereinafter a case in which the blade unit 100 includes the plurality of outlet holes 110*h* will be described as an example.

In the windless operation of the air conditioner 1, the air conditioner 1 may discharge air through the plurality of outlet holes 110*h*, thereby discharging air to the outside of the housing 10 at a low speed. That is, it is possible to implement a windless airflow. Accordingly, the air conditioner 1 may perform air conditioning while preventing the user from directly facing the wind, thereby improving user satisfaction.

As illustrated in FIG. 9, in the cooling operation of the air conditioner 1, the blade unit 100 may guide the discharged air to allow cold air to be discharged as horizontally as possible. Cold air goes down due to the convection, and thus the user is directly exposed to the cold air, which may increase the user's discomfort. Accordingly, the blade unit 100 may guide the discharged air to prevent the cold air from directly discharging downward, thereby reducing the user's inconvenience. However, it is not limited to the cooling operation, and according to the convenience of the user, even in the heating operation, the blade unit 100 may be arranged as illustrated in FIG. 9.

As illustrated in FIG. 10, in the heating operation of the air conditioner 1, the blade unit 100 may guide the discharged air to allow warm air to be discharged downward as much as possible. The warm air raises due to the convection and thus it may cause a difficulty in that a temperature felt by a user in the lower portion of the room is low. Accordingly, the blade unit 100 may improve heating efficiency by guiding the warm air to be discharged downward. However, it is not limited to the heating operation, and for the convenience of the user, the blade unit 100 may be arranged even in the cooling operation as illustrated in FIG. 10.

As illustrated in FIG. 11, in the high-speed operation of the air conditioner 1, the blade unit 100 may allow the discharged air to reach a greater distance at a high speed. Particularly, during the high-speed heating operation, warm air may reach the floor of the room to allow the entire room to be heated evenly. However, it is not limited to the heating operation, and a high-speed cooling operation may be performed when rapid indoor cooling is required. That is, the high-speed operation may include both the high-speed heating operation in which warm air is rapidly discharged downward and the high-speed cooling operation in which cold air is rapidly discharged downward.

Referring to FIG. 11, in the high-speed operation of the air conditioner 1, the blade angle 100*a* may be a maximum angle. For example, the blade angle 100*a* may be in a range of approximately 120° to 180°. However, the disclosure is not limited thereto, and the blade angle 110*a* may be about 180° or more. Further, the one side 110*a* of the main-blade 110 may be close to or in contact with the one side 120*a* of the sub-blade 120. The other side 120*b* of the sub-blade 120 may be close to or in contact with the first guide member 13 of the housing 10.

Figure 12:
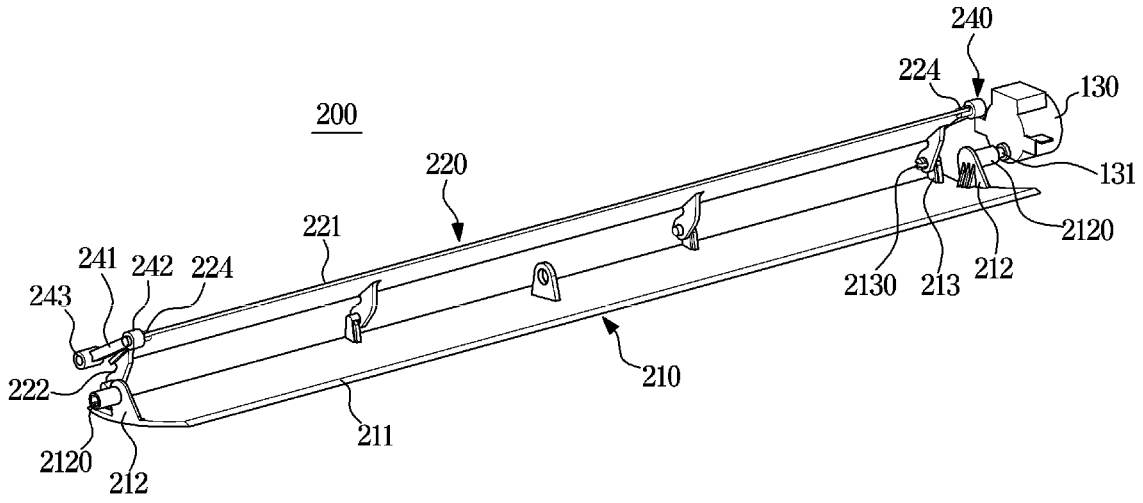
FIG. 12 is a view illustrating a blade unit according to another embodiment of the disclosure.
Figure 13:
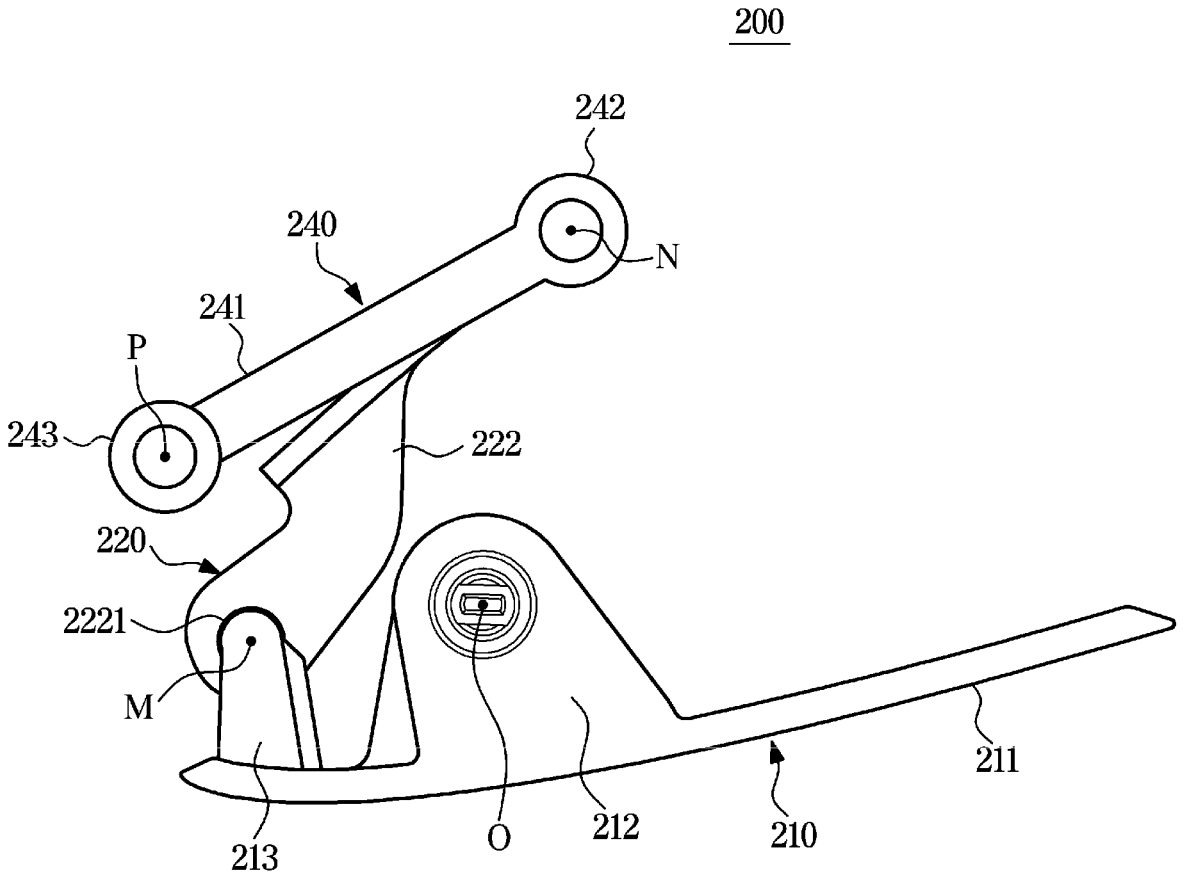
FIG. 13 is a side view illustrating the blade unit shown in FIG. 12.
Figure 14:
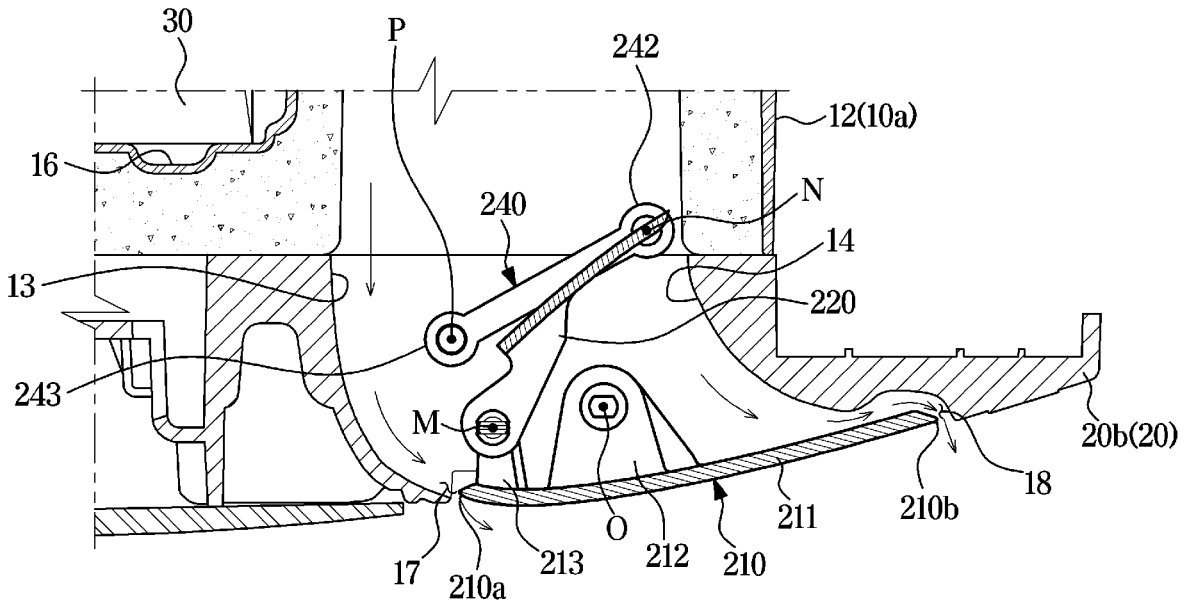
FIG. 14 is a view schematically illustrating a state in a first position of the blade unit shown in FIG. 13.
Figure 15:
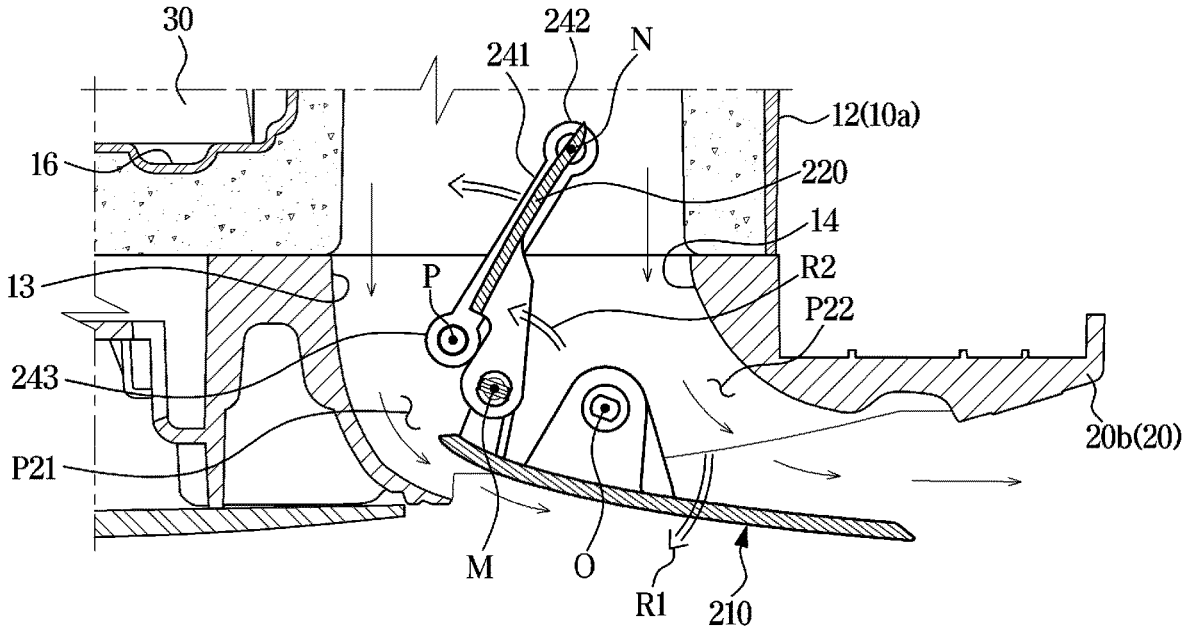
FIG. 15 is a view schematically illustrating a cooling operation of the blade unit shown in FIG. 13.
Figure 16:
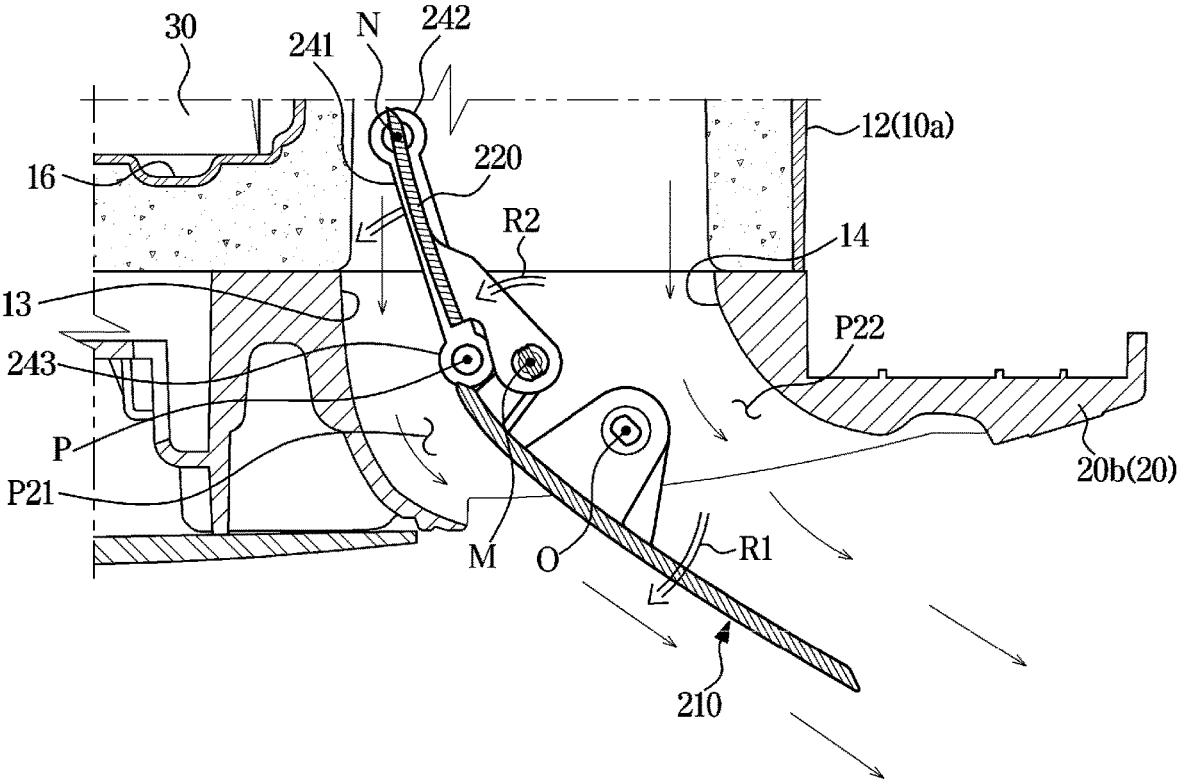
FIG. 16 is a view schematically illustrating a heating operation of the blade unit shown in FIG. 13.
Figure 17:
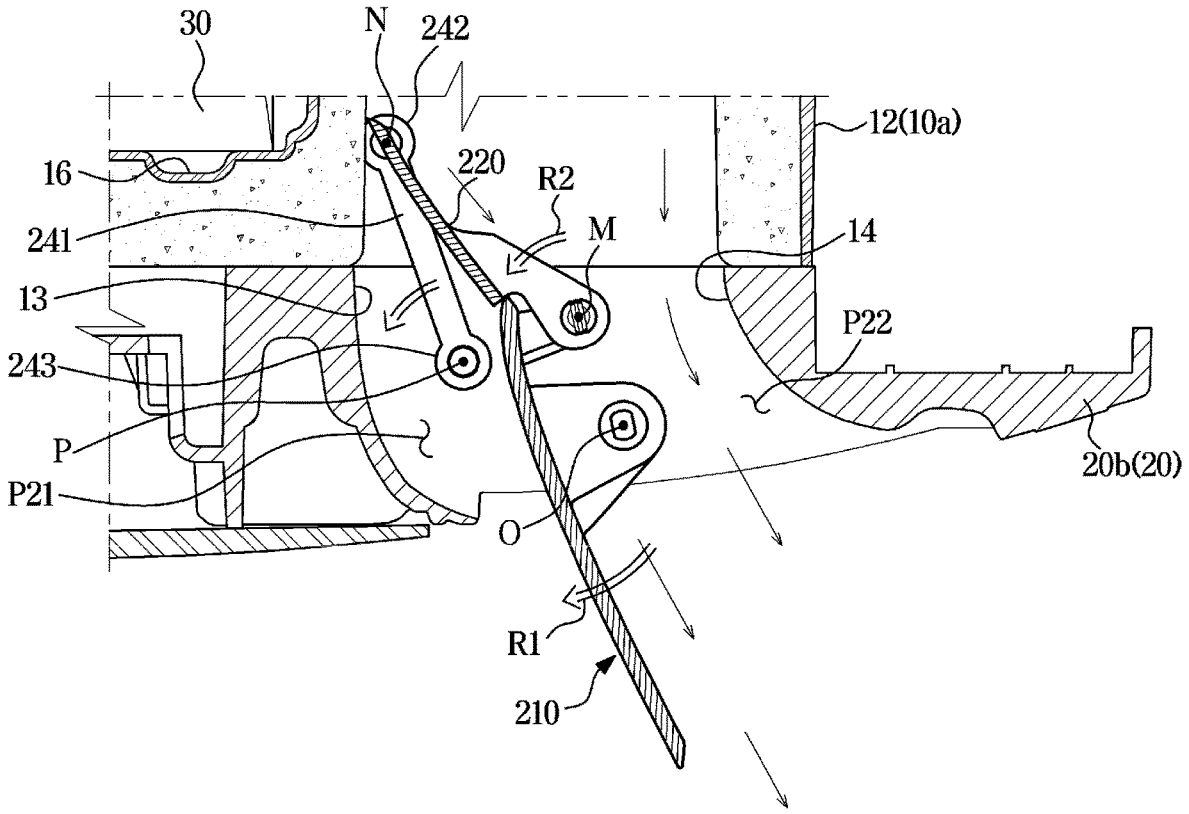
FIG. 17 is a view schematically illustrating a high-speed operation of the blade unit shown in FIG. 13.

FIG. 12 is a view illustrating a blade unit according to another embodiment of the disclosure. FIG. 13 is a side view illustrating the blade unit shown in FIG. 12. FIG. 14 is a view schematically illustrating a state in a first position of the blade unit shown in FIG. 13. FIG. 15 is a view schematically illustrating a cooling operation of the blade unit shown in FIG. 13. FIG. 16 is a view schematically illustrating a heating operation of the blade unit shown in FIG. 13. FIG. 17 is a view schematically illustrating a high-speed operation of the blade unit shown in FIG. 13.

A blade unit 200 (also referred to as a blade assembly 200) according to another embodiment of the disclosure will be described with reference to FIGS. 12 to 17. The blade unit 200 may be a rear type. That is, the second center of rotation P of the link 240 may be located at the rear of the first rotation center O of the main-blade 210. That is, the second rotation center P may be arranged adjacent to the inlet 21 than the first rotation center O.

Other configuration, arrangement and/or operation characteristics (e.g., the windless operation, the cooling operation, the heating operation, and the high-speed operation) are substantially the same as the blade unit 100 of the above-described embodiment, and the detailed description thereof will be omitted. For example, a main-blade 210 performs substantially the same function as the aforementioned main-blade 110, a sub-blade 220 performs substantially the same function as the aforementioned sub-blade 120, and a link 240 performs substantially the same function as the above-described link 140, and thus a detailed description will be omitted.

Referring to FIGS. 12 and 13, the blade unit 200 may include the main-blade 210 and the sub-blade 220. The blade unit 200 may be configured to rotate. The blade unit 200 may rotate within a predetermined angle range on the outlet 22. The main-blade 210 may rotate in a first direction R1, and the sub-blade 220 may rotate in a second direction R2 opposite to the first direction R1. The sub-blade 220 may move in accordance with the rotation of the main-blade 210.

The main-blade 210 may include a main-blade body 211, a motor coupler 212 extending from the main-blade body 211 and coupled to the motor 130, and a sub-blade coupler 213 extending from the main-blade body 211 and coupled to the sub-blade 220.

Although not shown in the drawings, the main-blade 210 may further include a plurality of outlet holes and/or grilles penetrating the main-blade body 211. The blade unit 200 may implement a windless airflow by discharging air through the plurality of outlet holes and/or grilles.

The sub-blade 220 may be provided to adjust the discharge speed of the air discharged through the outlet 22. For example, the sub-blade 220 may be provided to block a portion of the outlet flow path P2. Particularly, the sub-blade 220 may be provided to block the first outlet flow path P21. The sub-blade 220 may increase the speed of the air discharged through the outlet 22 by reducing the area of the flow path through which the air is discharged. Accordingly, because the air is discharged through the outlet 22 at a high speed, the air may reach a greater distance. Particularly, in the heating operation, the warm air may reach the lower portion of the room, thereby increasing the heating efficiency of the entire room.

The sub-blade 220 may include a sub-blade body 221 and a connector 222 extending from the sub-blade body 221.

The sub-blade 220 may include a first joint M rotatably coupled to the main-blade 210 and a second joint N rotatably coupled to the link 240. The first joint M may mean a coupler between the main-blade 210 and the sub-blade 220, and the second joint N may mean a coupler between the sub-blade 220 and the link 240.

Referring to FIG. 13, the second joint N may be positioned above the first joint M. With this arrangement structure, the sub-blade 220 may rotate in the opposite direction to the main-blade 210. That is, the sub-blade 220 may rotate in the second direction R2.

Although not shown, the sub-blade 220 may further include a plurality of outlet holes and/or grilles penetrating the sub-blade body 221.

The blade unit 200 may further include the link 240 guiding the movement of the sub-blade 220 to allow the sub-blade 220 to rotate in the second direction R2.

The link 240 may include a link body 241, one end 242 coupled to the sub-blade 220, and the other end 243 provided to form a second rotation center P. The one end 242 of the link 240 may be referred to as a first end 242, and the other end 243 of the link 240 may be referred to as a second end 243.

Hereinafter operation of the blade unit 200 will be described with reference to FIGS. 14 to 17.

The main-blade 210 may receive the rotational force from the motor 130 to rotate in the first direction R1. Particularly, in response to the rotation of the sub-blade coupler 213 in the first direction R1, the first joint M of the sub-blade 220 coupled to the sub-blade coupler 213 may also rotate in the first direction R1. The first joint M may move forward and upward while rotating in the first direction R1. In response to the movement of the first joint M, the link 240 connected to the second joint N may also rotate in accordance with the movement thereof. Based on the second rotation center P of the link 240 being located at the rear of the first rotation center O of the main-blade 210 (i.e., in the rear type), the link 240 may rotate in the direction (the second direction R2) opposite to the main-blade 210 with respect to the second rotation center P. Accordingly, by the rotation of the link 240 and the rotation of the main-blade 210, the connector 222 of the sub-blade 220 may be lifted, and the second joint N of the sub-blade 220 may move backward. That is, the sub-blade 220 may rotate in the direction opposite to the main-blade 210.

Referring to FIG. 17, the sub-blade 220 may block the rear of the outlet flow path P2 while rotating in the second direction R2. That is, the sub-blade 220 may block the first outlet flow path P21 of the outlet flow path P2. The heat-exchanged air may be discharged toward the outlet 22 through the second outlet flow path P22. Accordingly, during the heating operation, warm air may reach a greater distance at a high speed.

In this case, an angle between the main-blade 210 and the sub-blade 220 may be the maximum angle. For example, the angle between the main-blade 210 and the sub-blade 220 may be provided in a range of approximately 120° to 180°. However, the disclosure is not limited thereto, and the angle between the main-blade 210 and the sub-blade 220 may be approximately 180° or more. Further, one side 210*a* of the main-blade 210 and one side 220*a* of the sub-blade 220 may be provided to be close to or in contact with each other. The other side 220*b* of the sub-blade 220 may be provided to be close to or in contact with the first guide member 13 of the housing 10.

Figure 18:
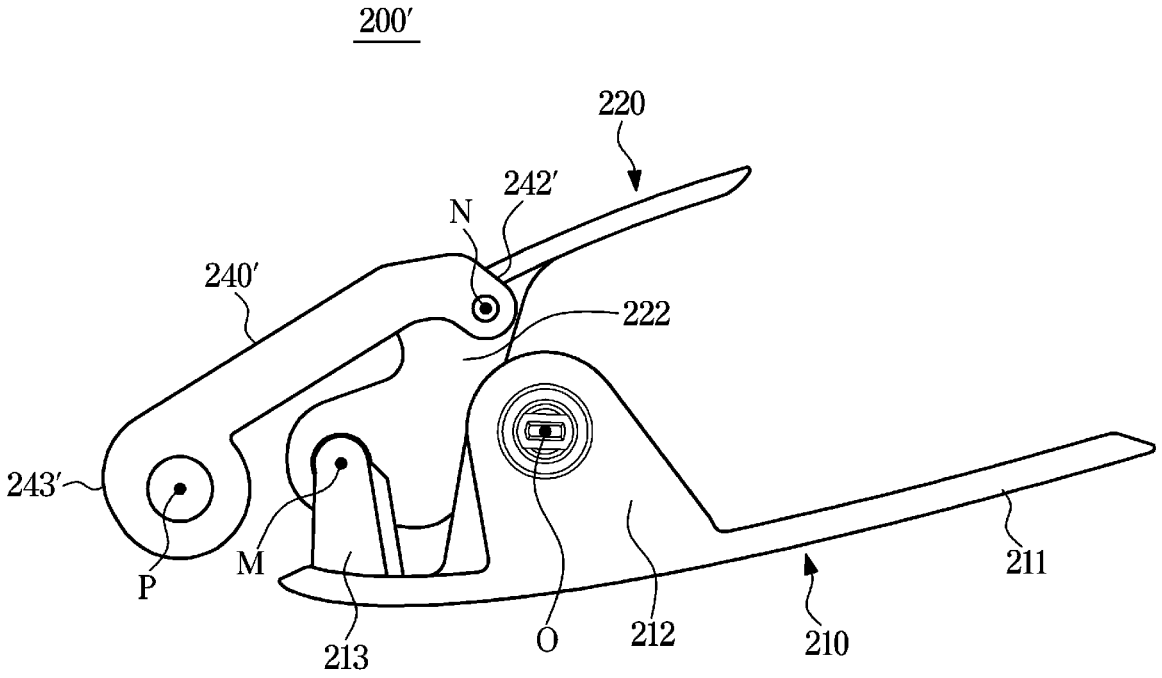
FIG. 18 is a view illustrating a blade unit according to still another embodiment of the disclosure.

FIG. 18 is a view illustrating a blade unit according to still another embodiment of the disclosure.

According to the above-described embodiment, the second joint N of the link 240 of the sub-blade 220 may be coupled to a front-side end 224 of the sub-blade 220, but according to the embodiment, a second joint N of a link 240' of a blade unit 200' (also referred to as a blade assembly 200') may not be coupled to a front-side end of the sub-blade 220. The second joint N of the link 240' may be coupled to a middle region of the sub-blade 220 with respect to the front and rear direction. However, the disclosure is not limited thereto.

Figure 19:
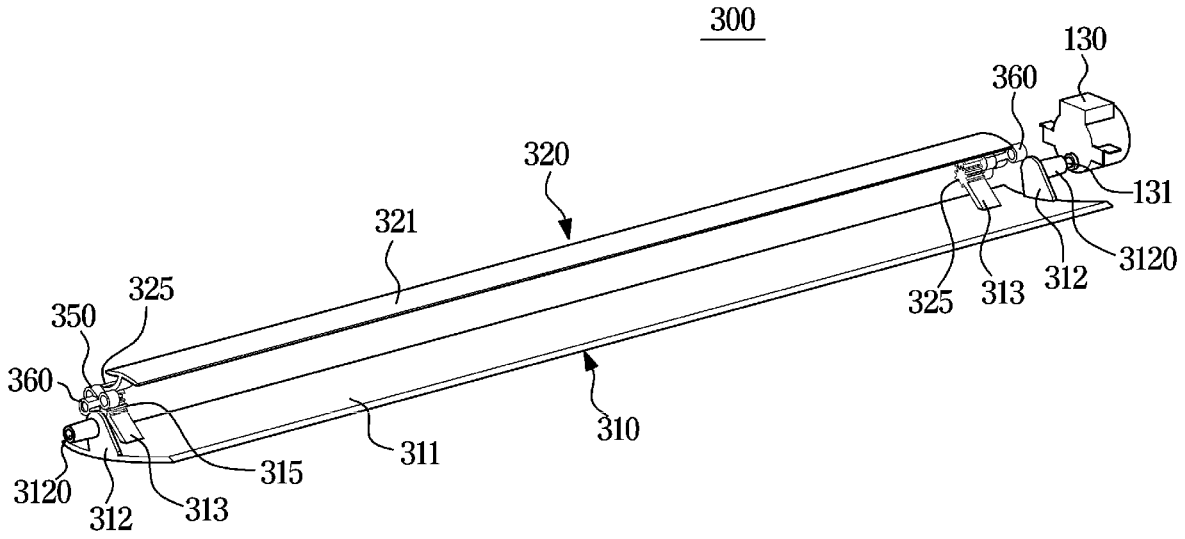
FIG. 19 is a view illustrating a blade unit according to still another embodiment of the disclosure.
Figure 20:
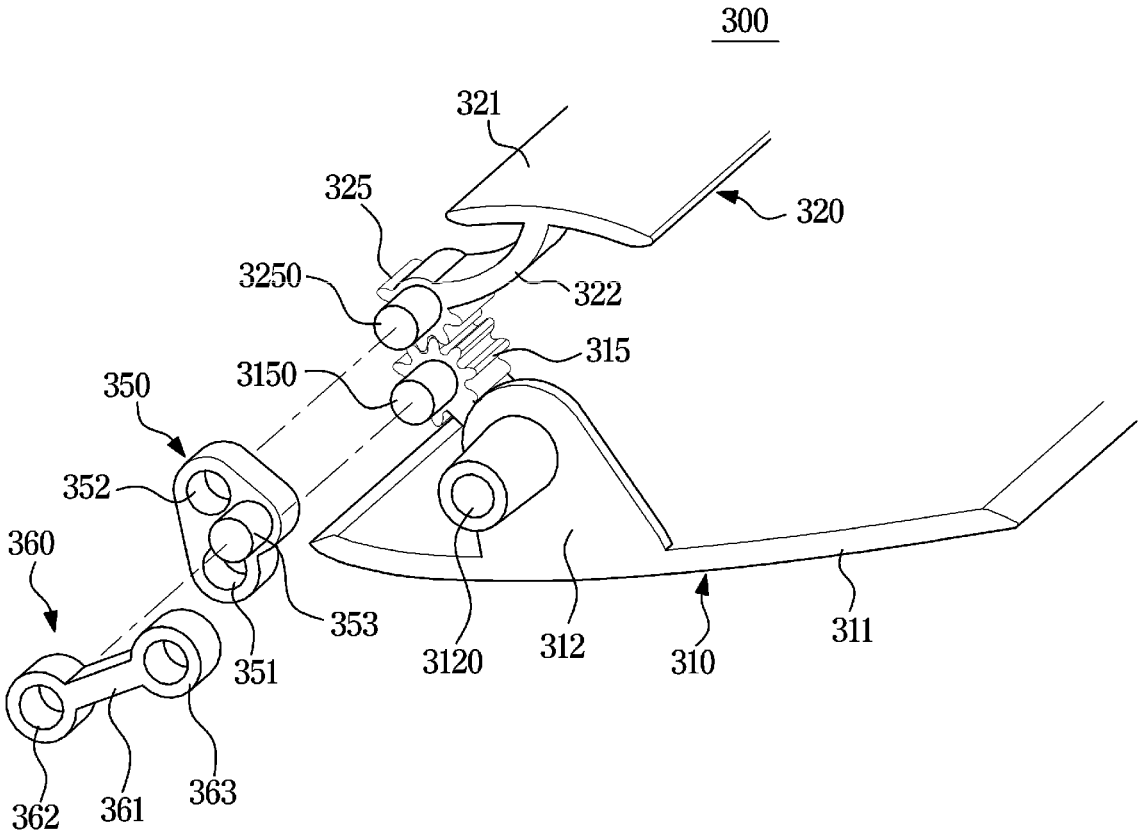
FIG. 20 is an exploded view illustrating the blade unit shown in FIG. 19.
Figure 21:
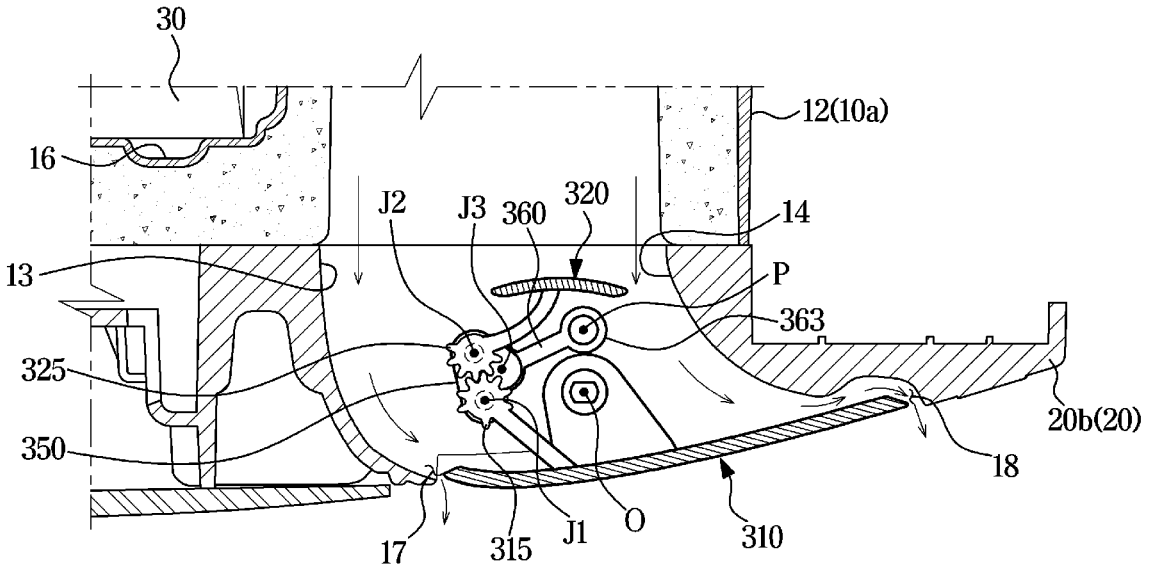
FIG. 21 is a view schematically illustrating a state in a first position of the blade unit shown in FIG. 19.
Figure 22:
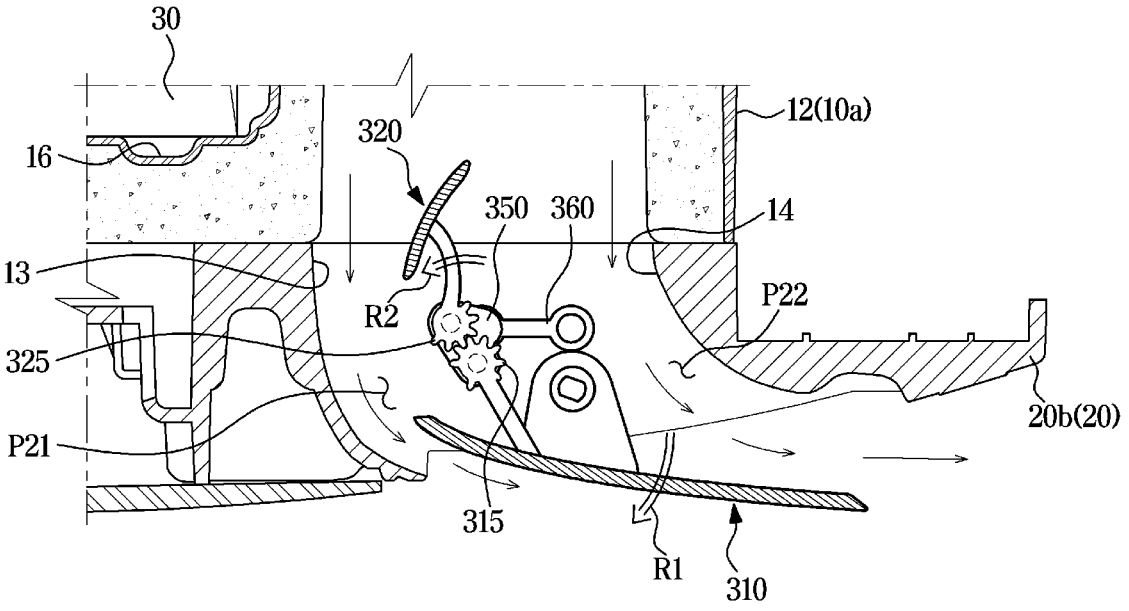
FIG. 22 is a view schematically illustrating a cooling operation of the blade unit shown in FIG. 19.
Figure 23:
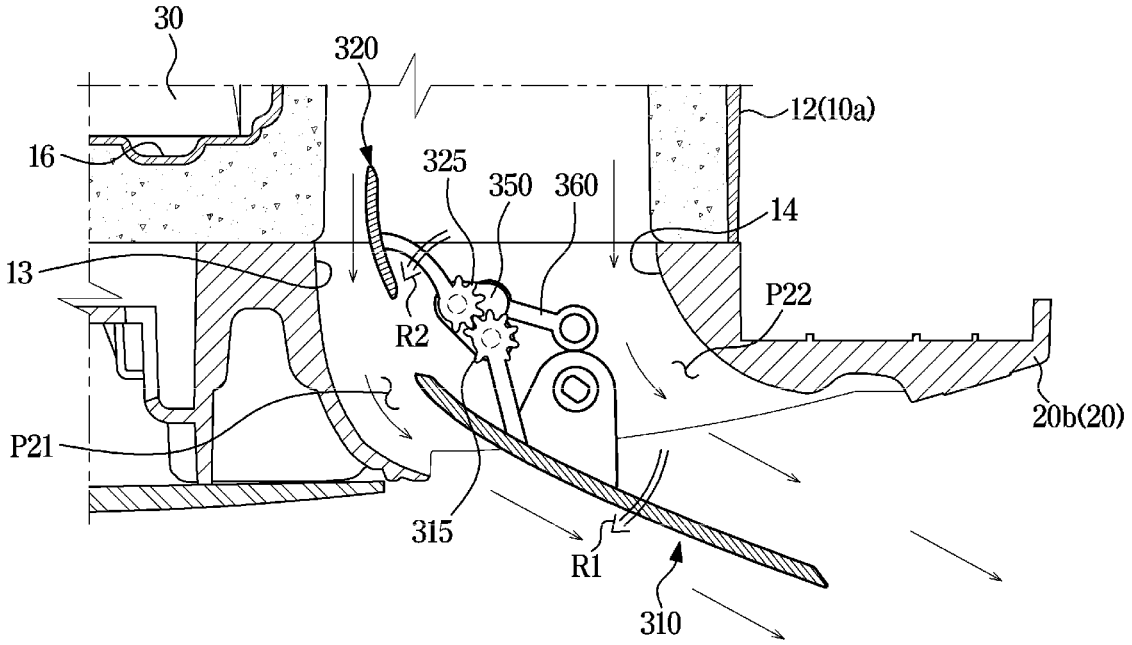
FIG. 23 is a view schematically illustrating a heating operation of the blade unit shown in FIG. 19.
Figure 24:
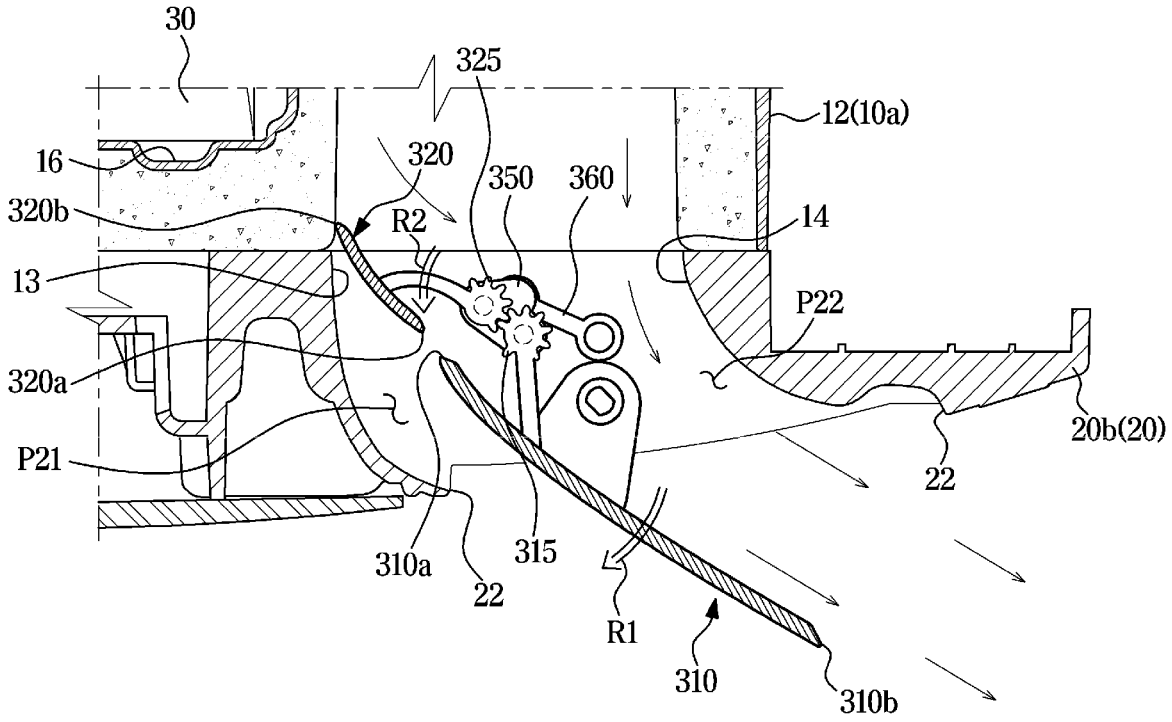
FIG. 24 is a view schematically illustrating a high-speed operation of the blade unit shown in FIG. 19.

FIG. 19 is a view illustrating a blade unit according to still another embodiment of the disclosure. FIG. 20 is an exploded view illustrating the blade unit shown in FIG. 19. FIG. 21 is a view schematically illustrating a state in a first position of the blade unit shown in FIG. 19. FIG. 22 is a view schematically illustrating a cooling operation of the blade unit shown in FIG. 19. FIG. 23 is a view schematically illustrating a heating operation of the blade unit shown in FIG. 19. FIG. 24 is a view schematically illustrating a high-speed operation of the blade unit shown in FIG. 19.

A blade unit 300 (also referred to as a blade assembly 300) according to still another embodiment of the disclosure will be described with reference to FIGS. 19 to 24. A detailed description of the components that perform substantially the same function as the blade units 100 and 200 of the above-described embodiment will be omitted. In addition, the blade unit 300 may perform substantially the same operation mode (e.g., the windless operation, the cooling operation, the heating operation, and the high-speed operation) as the blade units 100 and 200 of the above-described embodiment.

The blade unit 300 may include a main-blade 310 and a sub-blade 320. The blade unit 300 may be configured to rotate. The blade unit 300 may rotate within a predetermined angle range on the outlet 22. The main-blade 310 may rotate in a first direction R1, and the sub-blade 320 may rotate in a second direction R2 opposite to the first direction R1. The sub-blade 320 may move in accordance with the rotation of the main-blade 310.

The main-blade 310 may include a main-blade body 311, a motor coupler 312 extending from the main-blade body 311 and coupled to the motor 130, and a sub-blade coupler 313 extending from the main-blade body 311 and coupled to the sub-blade 320.

The sub-blade coupler 313 of the main-blade 310 may include a first gear 315. The first gear 315 may mesh with a second gear 325 of the sub-blade 320 to be described later. The first gear 315 may rotate in the first direction R1, and the second gear 325 meshing with the first gear 315 may rotate in the second direction R2. Due to the meshing between the gear shapes, it is possible to obtain stable rotation while preventing reverse rotation.

Although not shown in the drawings, the main-blade 310 may further include a plurality of outlet holes and/or grilles penetrating the main-blade body 311. The blade unit 300 may implement a windless airflow by discharging air through the plurality of outlet holes and/or grilles.

The sub-blade 320 may be provided to adjust the discharge speed of the air discharged through the outlet 22. For example, the sub-blade 320 may be provided to block a portion of the outlet flow path P2. Particularly, the sub-blade 320 may be provided to block the first outlet flow path P21. The sub-blade 320 may increase the speed of the air discharged through the outlet 22 by reducing the area of the flow path through which the air is discharged. Accordingly, because the air is discharged through the outlet 22 at a high speed, the air may reach a greater distance. Therefore, in the heating operation, the warm air may reach the lower portion of the room, thereby increasing the heating efficiency of the entire room.

The sub-blade 320 may include a sub-blade body 321 and a connector 322 extending from the sub-blade body 321. The connector 322 may include the second gear 325. The second gear 325 may be provided to mesh with the first gear 315 of the main-blade 310. The second gear 325 may rotate in the second direction R2 by the rotation of the first gear 315 in the first direction R1.

Referring to FIGS. 19 and 20, the blade unit 300 may further include a hinge 350 and a connecting rod 360. The hinge 350 and the connecting rod 360 may move in accordance with the rotation of the main-blade 310. In addition, the hinge 350 and the connecting rod 360 may guide the movement of the sub-blade 320 to allow the sub-blade 320 to rotate in the second direction R2.

The hinge 350 may be rotatably coupled to the main-blade 310, the sub-blade 320, and the connecting rod 360, respectively.

The hinge 350 may include a first coupler 351 rotatably coupled to the main-blade 310. For example, the first coupler 351 of the hinge 350 may be coupled to a protrusion 3150 protruding from the first gear 315. The hinge 350 may include a second coupler 352 rotatably coupled to the sub-blade 320. For example, the second coupler 352 of the hinge 350 may be coupled to a protrusion 3250 protruding from the second gear 325. The hinge 350 may include a third coupler 353 rotatably coupled to the connecting rod 360. For example, the third coupler 353 of the hinge 350 may be coupled to one end 362 of the connecting rod 360.

A coupler between the hinge 350 and the main-blade 310 may be referred to as a first joint J1, a coupler between the hinge 350 and the sub-blade 320 may be referred to as a second joint J2, and a coupler between the hinge 350 and the connecting rod 360 may be referred to as a third joint J3.

The connecting rod 360 may include a connecting rod body 361. One end 362 of the connecting rod 360 may be rotatably coupled to the hinge 350. The one end 362 may be coupled to the third coupler 353 of the hinge 350. The one end 362 may be provided to rotate the hinge 350 according to the rotation of the main-blade 310. The other end 363 of the connecting rod 360 may form a second rotation center P. The other end 363 of the connecting rod 360 may rotate with respect to the second rotation center P.

In the drawing, it is illustrated that the second rotation center P of the connecting rod 360 is located in front of the first rotation center O of the main-blade 110, that is, the blade unit 300 is a front type, but is not limited thereto. The blade unit 300 may be provided as a rear type in which the second rotational center P of the connecting rod 360 is located at the rear of the first rotational center O of the main-blade 110.

The main-blade 310 may receive the rotational force from the motor 130 to rotate in the first direction R1. In response to the rotation of the first gear 315 of the sub-blade coupler 313 in the first direction R1, the second gear 325 of the sub-blade 220 may mesh with the first gear 315 and rotate in the second direction R2. In addition, according to the rotation of the main-blade 310, the first coupler 351 of the hinge 350 may move forward and upward. According to the movement of the hinge 350, the connecting rod 360 may rotate with respect to the second rotation center P. In addition, the third coupler 353 of the hinge 350 may be lifted by the rotation of the connecting rod 360, and the hinge 350 may rotate in a predetermined range in the second direction R2. Accordingly, the sub-blade 320 may move backward. That is, the hinge 350 and the connecting rod 360 may guide the sub-blade 320 to allow the sub-blade 320 to rotate stably in the second direction R2.

Referring to FIG. 24, the main-blade 310 may further rotate in the first direction R1, and the sub-blade 320 may further rotate in the second direction R2 in comparison with FIG. 23. Accordingly, the blade unit 300 may guide the air to be discharged to the further lower side. Further, the sub-blade 320 may block the rear of the outlet flow path P2 while rotating in the second direction R2. That is, by blocking the first outlet flow path P21 of the outlet flow path P2, an area of the flow path, through which air is discharged, may be reduced. The heat-exchanged air may be discharged toward the outlet 22 through the second outlet flow path P22. Accordingly, during the heating operation, warm air may reach a greater distance at a high speed.

In this case, an angle between the main-blade 310 and the sub-blade 320 may be the maximum angle. For example, the angle between the main-blade 310 and the sub-blade 320 may be provided in a range of approximately 120° to 180°. However, the disclosure is not limited thereto, and may be provided at about 180° or more. In addition, the first side 310*a* of the main-blade 310 and the first side 320*a* of the sub-blade 320 may be provided to be close to or in contact with each other. The second side 320*b* of the sub-blade 320 may be provided to be close to or in contact with the first guide member 13 of the housing 10.

As is apparent from the above description, an air conditioner may increase a speed of air discharged from an outlet.

An air conditioner may allow air, which is discharged from an outlet, to reach a greater distance.

An air conditioner may discharge air in various ways to make a user feel comfortable.

Although a few embodiments of the disclosure have been shown and described, it would be appreciated by those skilled in the art that changes may be made in these embodiments without departing from the principles and spirit of the disclosure, the scope of which is defined in the claims and their equivalents,

What is claimed is:

1. An air conditioner comprising:

a housing comprising an inlet and an outlet;

a heat exchanger arranged inside the housing to exchange heat with air suctioned through the inlet;

a fan configured to move the air, which is heat-exchanged with the heat exchanger, to be discharged through the outlet;

a motor configured to generate a rotational force; and a blade assembly configured to guide the air to the outlet and receive the rotational force from the motor, the blade assembly comprising;

a main-blade configured to rotate in a first direction with respect to a first rotation center of the main-blade and adjust a discharge direction of the air discharged through the outlet based on the rotational force received from the motor, a sub-blade rotatably coupled to the main-blade and configured to rotate in a second direction opposite to the first direction, based on the rotation of the main-blade in the first direction, to adjust a discharge speed of the air discharged through the outlet, the sub-blade including a first joint rotatably coupled to the main-blade and a second joint spaced apart from the first joint, and a link provided to guide movement of the sub-blade by rotating with respect to a second rotation center so that the sub-blade rotates in the second direction, the link including a first end rotatably coupled to the second joint of the sub-blade and a second end provided to form the second rotation center.

2. The air conditioner of claim 1, wherein an outlet flow path is provided between the fan and the outlet, housing comprises;

a first guide member arranged adjacent to the inlet, and a second guide member arranged to be outwardly spaced apart from the first guide member so as to form at least a portion of the outlet flow path, and the outlet flow path comprises;

a first outlet flow path formed between the blade assembly and the first guide member; and a second outlet flow path formed between the blade assembly and the second guide member.

3. The air conditioner of claim 2, wherein in response to the rotation of the main-blade in the first direction, an area of the first outlet flow path is reduced and an area of the second outlet flow path is increased.

4. The air conditioner of claim 2, wherein in a heating operation, the main-blade rotates in the first direction to guide the air, which is discharged through the outlet, toward a lower side, and the sub-blade rotates in the second direction to block the first outlet flow path.

5. The air conditioner of claim 3, wherein the second joint is positioned above the first joint.

6. The air conditioner of claim 1, wherein the sub-blade is rotatably coupled to an end close to the inlet of the main-blade to form an angle with the main-blade, wherein in a heating operation, an angle between the main-blade and the sub-blade is 120° to 180°.

7. The air conditioner of claim 2, wherein the link rotates in a same direction as the main-blade in response to the second rotation center of the link being located in front of the first rotation center of the main-blade.

8. The air conditioner of claim 2, wherein the link rotates in a direction opposite to the main-blade in response to the second rotation center of the link being located behind the first rotation center of the main-blade.

9. The air conditioner of claim 2, wherein the link comprises a curved shape.

10. The air conditioner of claim 1, wherein the main-blade further comprises a main-blade body; and a plurality of outlet holes penetrating the main-blade body, wherein the air is discharged through plurality of outlet holes in response to closing the outlet by the main-blade.

11. The air conditioner of claim 1, wherein the motor comprises a stepper motor.

* * * * *